US009060632B2

(12) United States Patent
Berglund

(10) Patent No.: US 9,060,632 B2
(45) Date of Patent: Jun. 23, 2015

(54) BIODEGRADABLE TOYS AND METHODS OF MAKING SAME

(76) Inventor: David A. Berglund, Minnetonka, MN (US)

( * ) Notice: Subject to any disclaimer, the term of this patent is extended or adjusted under 35 U.S.C. 154(b) by 0 days.

(21) Appl. No.: 13/442,726

(22) Filed: Apr. 9, 2012

(65) Prior Publication Data

US 2013/0061499 A1 Mar. 14, 2013

Related U.S. Application Data

(60) Provisional application No. 61/472,768, filed on Apr. 7, 2011.

(51) Int. Cl.
*A47G 29/122* (2006.01)
*G09F 1/00* (2006.01)

(52) U.S. Cl.
CPC ..... *A47G 29/1209* (2013.01); *G09F 1/00* (2013.01)

(58) Field of Classification Search
CPC . A47G 29/1209; A47G 29/1216; B65D 5/00; B65D 5/02; B65D 5/029; B65D 5/5206; G09F 1/00
USPC ..... 232/17, 45, 38, 39; 40/607.1, 606.06; 229/116.1; 220/6; 248/150, 152, 528, 248/529, 136, 165, 166; 211/85; D99/32; 446/76, 487, 488
See application file for complete search history.

(56) References Cited

U.S. PATENT DOCUMENTS

| | | | | | |
|---|---|---|---|---|---|
| 2,530,950 | A * | 11/1950 | Ebert et al. | 40/124.09 |
| 3,099,389 | A * | 7/1963 | Vadnai | 232/24 |
| 3,787,987 | A * | 1/1974 | Brass | 434/178 |
| 4,359,185 | A * | 11/1982 | Castro | 232/17 |
| 4,522,598 | A * | 6/1985 | Coyne et al. | 434/259 |
| 4,950,202 | A * | 8/1990 | Florio | 446/219 |
| 5,009,366 | A * | 4/1991 | van Druff et al. | 232/17 |
| D335,903 | S * | 5/1993 | Swindle | D21/483 |
| 5,332,093 | A * | 7/1994 | Littlepage | 206/457 |
| 6,619,541 | B2 * | 9/2003 | Martin et al. | 232/38 |
| 6,772,938 | B2 * | 8/2004 | Martin et al. | 232/38 |
| 7,163,140 | B1 * | 1/2007 | Kaiser | 232/38 |
| 7,207,439 | B2 * | 4/2007 | Casella | 206/459.1 |
| 7,318,548 | B2 * | 1/2008 | Felice et al. | 232/45 |
| 7,726,552 | B2 * | 6/2010 | Chadima | 232/44 |
| 8,390,850 | B2 * | 3/2013 | Writt | 358/1.15 |
| 2002/0014525 | A1 * | 2/2002 | Webb | 232/45 |
| 2008/0194177 | A1 * | 8/2008 | Blanish | 446/491 |

* cited by examiner

*Primary Examiner* — William Miller
(74) *Attorney, Agent, or Firm* — Winthrop & Weinstine, P.A.

(57) ABSTRACT

The present disclosure, in one embodiment, relates to a biodegradable mailbox that includes a receptacle. The receptacle has a post attachment integral with the receptacle. The mailbox also includes a post, the post having a first end and a second end, the first end being securely insertable into the post attachment of the receptacle. The mailbox also includes a base into which the second end of the post is securely inserted. The mailbox is comprised of cardboard and contains no glue.

14 Claims, 62 Drawing Sheets

BIODEGRADABLE TOYS AND METHODS OF MAKING SAME

CROSS REFERENCE TO RELATED APPLICATION

The application claims priority to U.S. Provisional Application No. 61/472,768, filed on Apr. 7, 2011, which is hereby incorporated herein in its entirety.

FIELD OF THE INVENTION

The present disclosure relates to toys and other items that may be made using various substantially biodegradable and/or recyclable materials or combinations of materials, including, for example, cardboard. More particularly, the present disclosure relates to biodegradable and/or recyclable toys that are formed by using a combination of novel folding patterns in some embodiments, without the use of glue or in other embodiments a minimum amount of glue or adhesive, wherein the combination of folding patterns may be used to create a variety of typical geometries such as squares, rectangles, pyramids, etc. that may be combined to form end products of virtually any geometry. Even more particularly, the present disclosure relates to biodegradable mailboxes and signs.

BACKGROUND OF THE INVENTION

The creation and sale of toys is a multi-billion dollar industry. Despite the existence of generally countless types and designs of toys, new toys continue to be developed and sold. As a result, millions of toys are purchased annually and then in many cases discarded a short time thereafter, either because the child has lost interest in the toy, developed beyond the toy's usefulness, or simply because newer toys have been purchased. This cycle of toy purchasing and toy discarding has resulted in an enormous waste problem. Many toys are comprised in whole or in part of non-biodegradable materials or materials that may degrade, albeit very slowly. As landfills continue to grow in size, a need has arisen to produce more biodegradable products, particularly for products that greatly contribute to the waste problem, such as toys. Another issue related to children's toys concerns the toxic chemicals used to make and/or connect component parts of the toys. This problem may be significantly exacerbated when toxic or harmful chemicals or materials are included in removable parts or small parts that may be put in a child's mouth or swallowed by a child. Additionally, many parents wish to provide their child with toys that foster creativity, independence, and/or responsibility, for example.

Because customers are becoming more health conscious as well as more environmentally responsible, they are beginning to demand products that are in line with these values. This may be particularly true when customers are buying items for their children. Therefore, there is a need for children's toys and/or adult props etc. that are generally entirely biodegradable, made of non-harmful substances, and/or designed to allow the user to engage with the product and express their individuality and creativity.

BRIEF SUMMARY OF THE INVENTION

The present disclosure, in one embodiment, relates to a biodegradable mailbox that includes a receptacle. The receptacle has a post attachment integral with the receptacle. The mailbox also includes a post, the post having a first end and a second end, the first end being securely insertable into the post attachment of the receptacle. The mailbox also includes a base into which the second end of the post is securely inserted. The mailbox is comprised of cardboard and contains no glue.

Another embodiment of the present disclosure comprises a biodegradable sign that includes a sign face. The sign face includes a frame with a front side and a back side, and a placard, wherein the placard is removable and replaceable. The sign also includes a post attachment that is secured to the back side of the frame. The sign further includes a post, the post has a first end and a second end, the first end being securely insertable into the post attachment. Further, the sign includes a base, the second end of the post being securely insertable into the base. The sign is comprised of recyclable and biodegradable cardboard.

While multiple embodiments are disclosed, still other embodiments of the present disclosure will become apparent to those skilled in the art from the following detailed description, which shows and describes illustrative embodiments of the disclosure. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the disclosure will be better understood from the following description taken in conjunction with the accompanying Figures, in which:

DETAILED DESCRIPTION

Figure 1:
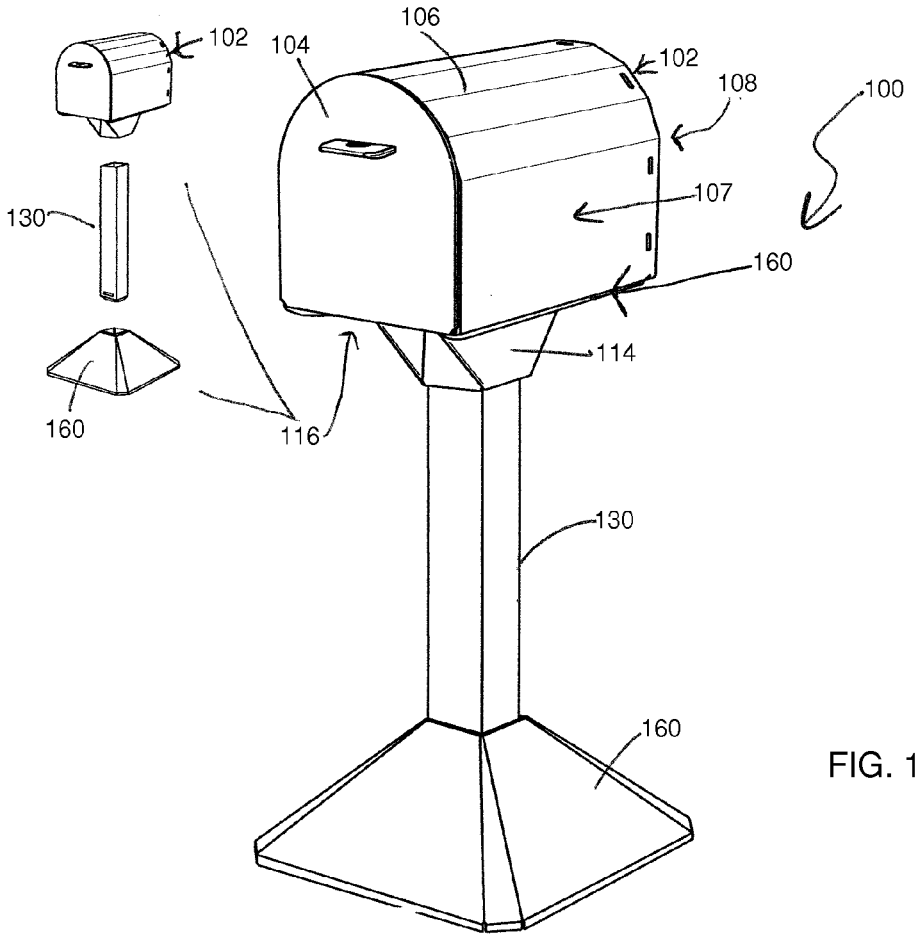
FIG. 1 illustrates the elements of a mailbox, in accordance with one embodiment.

The present disclosure relates to toys and other items that may be made using various substantially biodegradable and/or recyclable materials or combinations of materials, including, for example, cardboard. More particularly, the present disclosure relates to biodegradable toys that are formed by using a combination of novel folding patterns in some embodiments, without the use of glue or in other embodiments a minimum amount of glue or adhesive material, wherein the combination of folding patterns may be used to create a variety of typical geometries such as squares, rectangles, pyramids, etc. that may be combined to form end products of virtually any geometry. While embodiments of the present disclosure will generally be described herein with reference to toys, such as a mailbox or a sign, it will be understood that other objects or end products are within the spirit and scope of the present disclosure. Advantageously, in some embodiments, the toys of the present disclosure may be formed with little to no small hard parts, which may be particularly advantageous for children who are known to put toys or other items in their mouths. Ingesting adhesives or small parts may be harmful to people. Accordingly, limiting or eliminating the use of adhesives or small parts may be beneficial.

In some embodiments, users may assemble the toy(s) themselves, which may provide part of the enjoyment of the toy, in much the same way as some users enjoy assembling model cars or airplanes, for example. In other cases, the toy may be provided partially or completely assembled. Regardless of whether, or to what degree the toy(s) may be assembled, in some embodiments, a user may decorate the toy, in order to personalize and/or make the toy look more real. For example, a user may use paints, finger paints, markers, coloring crayons, poster board, paper, or crepe paper, for example, glitter, pom-poms, or any other decorative material to personalize a toy of the present disclosure. In other embodiments, the toy(s) may be provided already decorated, or partially decorated.

The object may be configured for children of a particular age. Accordingly, the size, scale, type of toy and/or complexity of a toy may be directed to children of a particular age and/or height and/or weight, for example. In other embodiments, the toys may be configured for use by older kids and/or adults for use in connection with performances, such as plays, skits, or games, and/or for decorating for theme parties, or other events, for example.

The present disclosure includes toys of nearly limitless variety. For example, the toys may include small-scale kitchen models, such as a kitchen sink and cabinet, refrigerator, or dishwasher; office items, such as a desk, bookshelves, or filing cabinets; and/or stage props, such as trees, benches, tables, small-scale houses, mailboxes, signs, cars, boats, airplanes, animals, instruments, sports goals, or puppet stages, for example. While various specific items have been described, it will be understood that the present disclosure may include generally any item that may be constructed from a biodegradable material. In some embodiments, the use of a double reverse fold, fold-in tabs, double fold gussets and/or folded corner winged tabs, for example may allow for simple, and/or complex shapes to be formed and/or combined to make nearly any item with nearly any geometry.

Some embodiments of the present disclosure may represent toys with complex forms, assemblies and original aesthetic, mechanical, safety and structural details. For example, as previously stated, the scale and appearance of the toys may be designed for children of a particular age (e.g. children 2-5 years old). The material selection may also allow children to personalize the toy with crayons, markers, and/or other adornments or embellishments that may be affixed to the toy. The material comprising the toy may generally be recyclable and/or biodegradable. The toy may be made from various thicknesses and grades of corrugated cardboard, chip-board or other sheet materials including but not limited to sheet metal and plastic, for example.

Mailbox

In one embodiment, a recyclable, biodegradable mailbox is provided that may also be decorated. As shown in FIG. 1, some embodiments of a mailbox 100 may generally comprise a receptacle 102, a post 130, and a base 160. The mailbox may be comprised of any suitable material, for example, but not limited to corrugated cardboard of any thickness and grade. The mailbox may be configured to have any desired dimensions.

In some embodiments, the receptacle 102, post 130, and base 160 may be constructed individually and then combined to form the completed mailbox 100, while in other embodiments two or more of the mailbox elements may be comprised of the same blank of material. Provided below are a number of embodiments for each of the mailbox elements 102, 130, 160 and their component parts. As may be appreciated, embodiments of the present disclosure include mailboxes comprised of any combination of the embodiments of elements described below, regardless of whether each particular combination is described.

It will also be recognized that the design features of mailbox elements 102, 130, 160 and their component parts lend themselves to myriad unrelated product possibilities by providing compact connectable tight fitting structural elements. Specifically, the "double reverse fold" (described further below) may allow for anything from cylinders to cubes to be buckled together without the need for adhesives, tapes or complex folding. Design details such as winged corner tabs and tuck under bottom panels captured by a fold under tapered flange may be used to create any polygonal structural pyramid shape without glue or adhesives, for example. Further, the double fold gussets included in some aspects of the mailbox my optimize the structural integrity of the pieces and the fold-in tabs and locking teeth design features allow for tight and secure joints between parts that may be readily adaptable for use in embodiments of any other suitable and desired geometry. Each of the above noted design elements will be discussed in further detail below.

Mailbox Receptacle

The mailbox receptacle 102 may include a back panel 108, a top 106, wherein the top 106 includes "sides" 107 that may be generally parallel to one another, a door 104 and/or a bottom panel 116 that may include a post attachment 114, in some embodiments. In some cases, the door 104 and/or post attachment 114 may be integral with the cardboard (or other suitable material) blank used to make the receptacle 102, while in other cases, the door 104 and/or post attachment 114 may be individually constructed and then attached to the receptacle 102.

In one embodiment, the mailbox receptacle including the door may be stamped from one contiguous piece of cardboard, such that the back panel, top, and door are all formed from the same piece. In other embodiments, the receptacle may be formed from two or more pieces. For example, the top portion may be formed as a general "U" shape from one piece of cardboard, and the back panel, bottom, and door may be formed from another piece of cardboard in a general "L" shape. In still other embodiments, other configurations are possible. The blank or blanks used to form the mailbox may have perforations, pre-folds, and/or markings to indicate where folds are to be made and in the case of perforations and pre-folds, the material may be made suitably conducive to folding by already beginning the fold, or by generally weakening the cardboard at the area of the intended fold to make it easier to fold.

Figure 2:
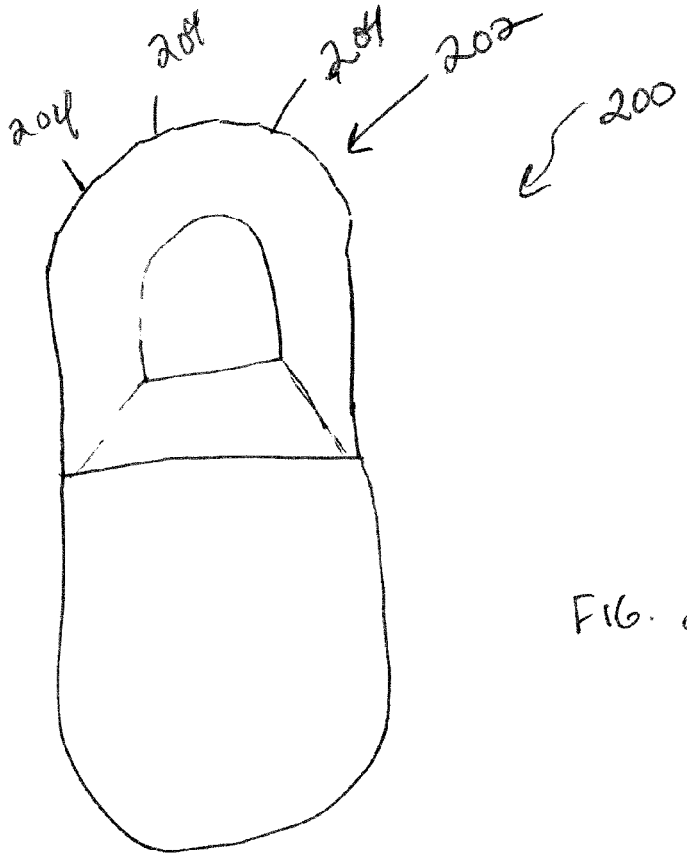
FIG. 2 illustrates a cardboard blank used to make a mailbox receptacle, in accordance with one embodiment.

A plurality of folds may be formed in the blank that may result in a plurality of facets 204 in the top arch 202 of the constructed receptacle 200, as shown in FIG. 2. The number of facets 204 may be any suitable number, including 7, 11, 18, or any other desired number. In some embodiments, the folds created in the blank may be equally spaced so as to create facets of equal widths, while in other embodiments the folds may have varying widths. The number of facets may be determined based on the desired look of the receptacle.

Figure 3:
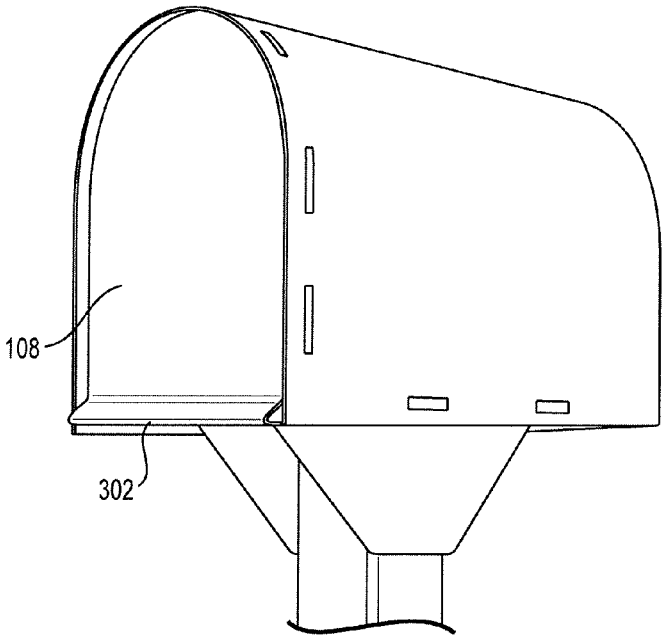
FIG. 3 illustrates the use of a double reverse fold in a receptacle, in accordance with one embodiment.
Figure 4A:
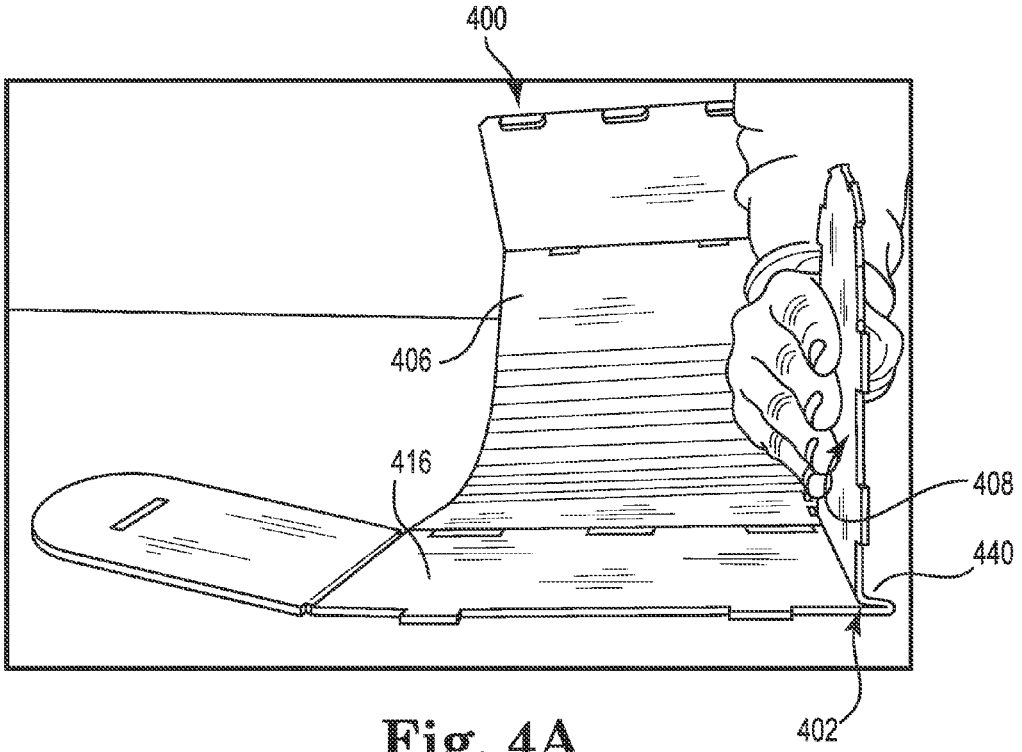
FIGS. 4A-4C illustrates the use of a double reverse fold in the formation of a receptacle, in accordance with one embodiment.
Figure 4B:
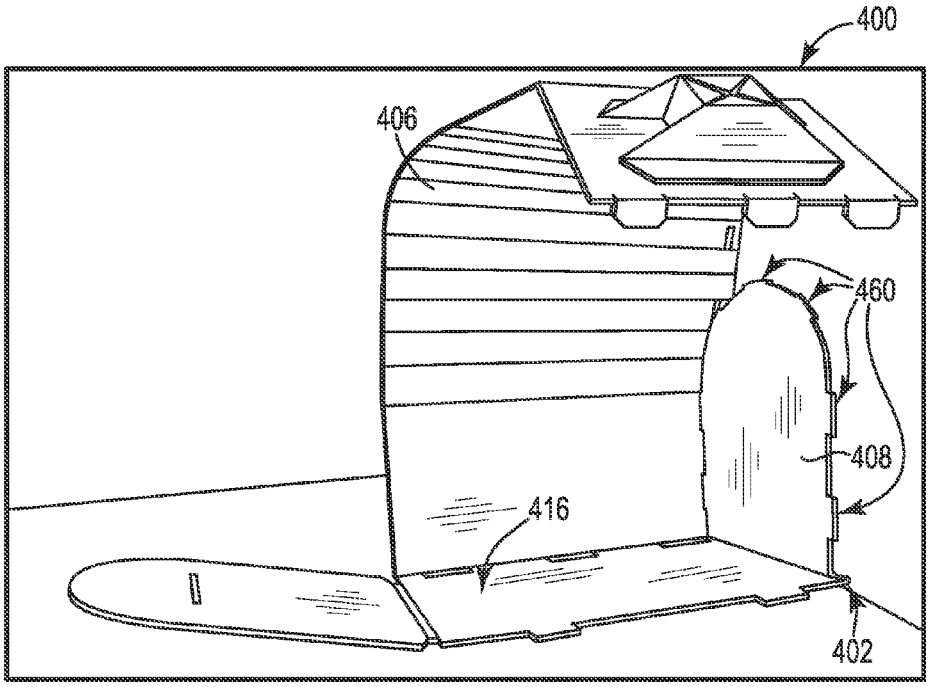
Figure 4C:
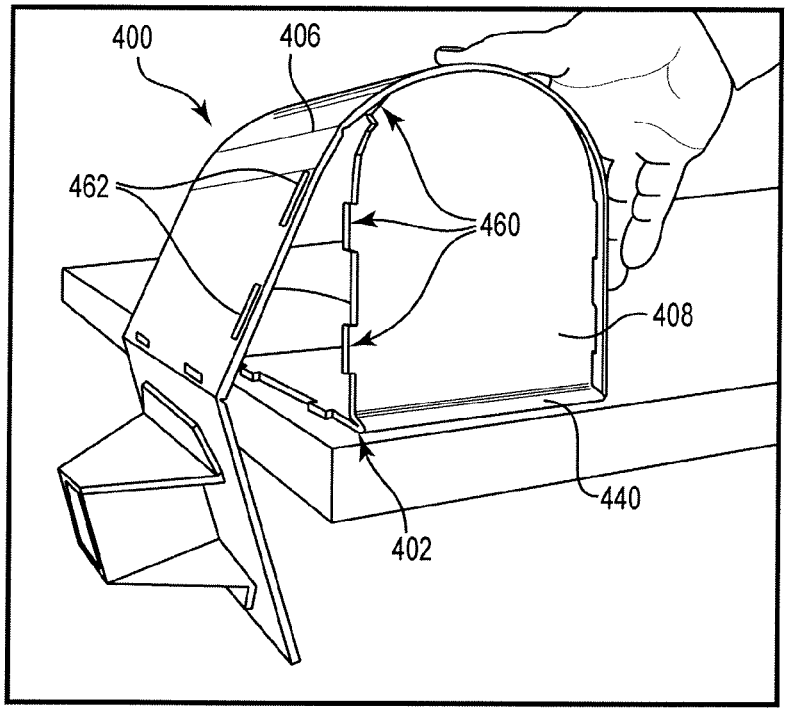

An advantageous and novel folding element in some embodiments includes a "double reverse fold" that may be used in one example to allow the back panel of the receptacle to be tucked inside of the receptacle and held in place by one or more tabs that may be located in the back panel, whereby the tabs may fit into receiving slots in the top of the receptacle in some embodiments. The double reverse fold 302 advantageously provides stability for the overall structure and it also allows for construction of the receptacle without the use of, or with minimal use of adhesives. The double reverse fold 302 generally creates a spring like tension that pushes the back panel 108 tight into the receptacle as shown in FIG. 3. FIGS. 4A-4C illustrate one embodiment of the double reverse fold used to construct a receptacle 400 made from a unitary piece of cardboard. The double reverse fold 402 is shown at the intersection of the back panel 408 and the bottom panel 416. The double reverse fold may be formed from two parallel folds spaced about ½ A inch apart and folded in opposite (reverse) directions. The first fold may be formed at 180° such that the cardboard lays back flat upon itself creating two layers of cardboard, and the second fold may be folded back at about 90° such that the back panel stands about 90° relative to the bottom panel. The reverse fold creates a lip 440 where the cardboard is comprised of two layers.

The back panel 408 may have one or more retaining tabs 460 positioned along the outer perimeter. The retaining tabs may be of any desired configuration including size and shape such that they may be compatible with the receiving slots 462 located in the top 406 of the receptacle.

Figure 5:
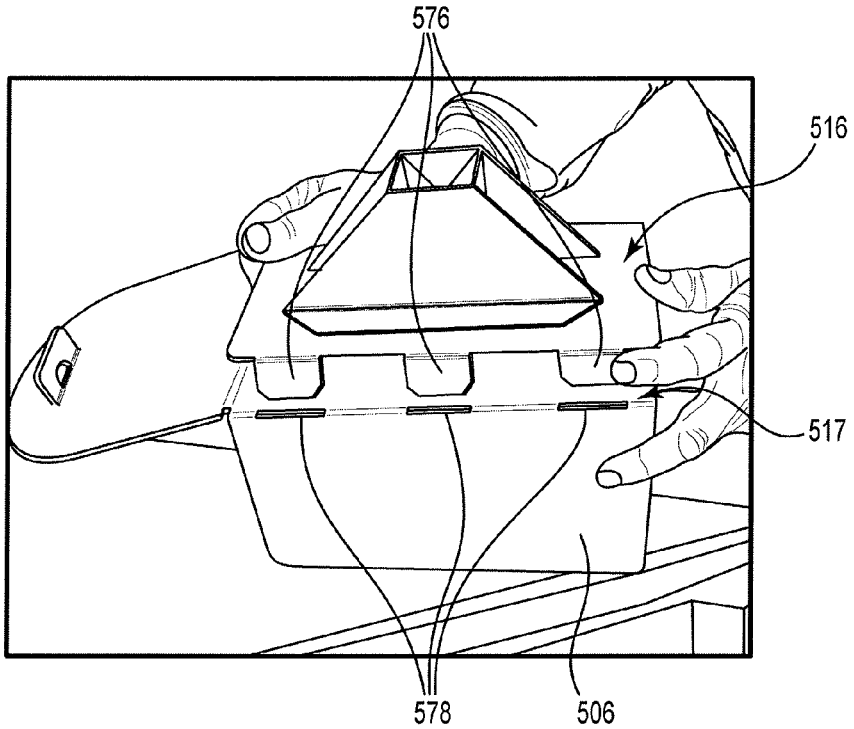
FIG. 5 illustrates a two layer bottom panel design for forming a receptacle, in accordance with one embodiment.
Figure 6:
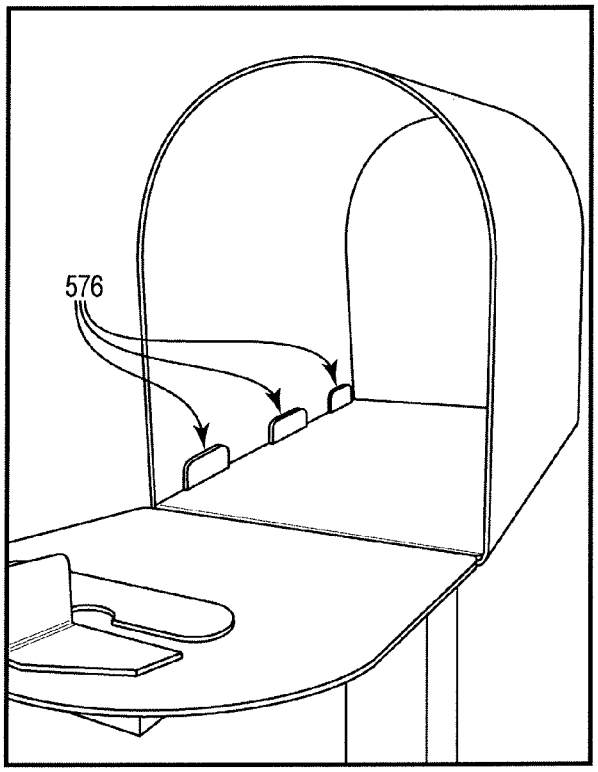
FIG. 6 illustrates a securing mechanism for one embodiment of a two layer bottom panel design, in accordance with one embodiment.
Figure 7:
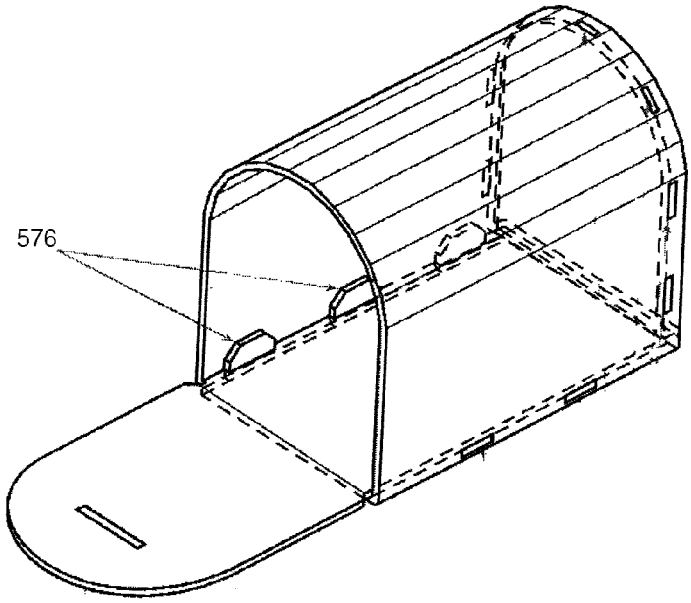
FIG. 7 illustrates a securing mechanism for one embodiment of a two layer bottom panel design, in accordance with one embodiment.
Figure 8:
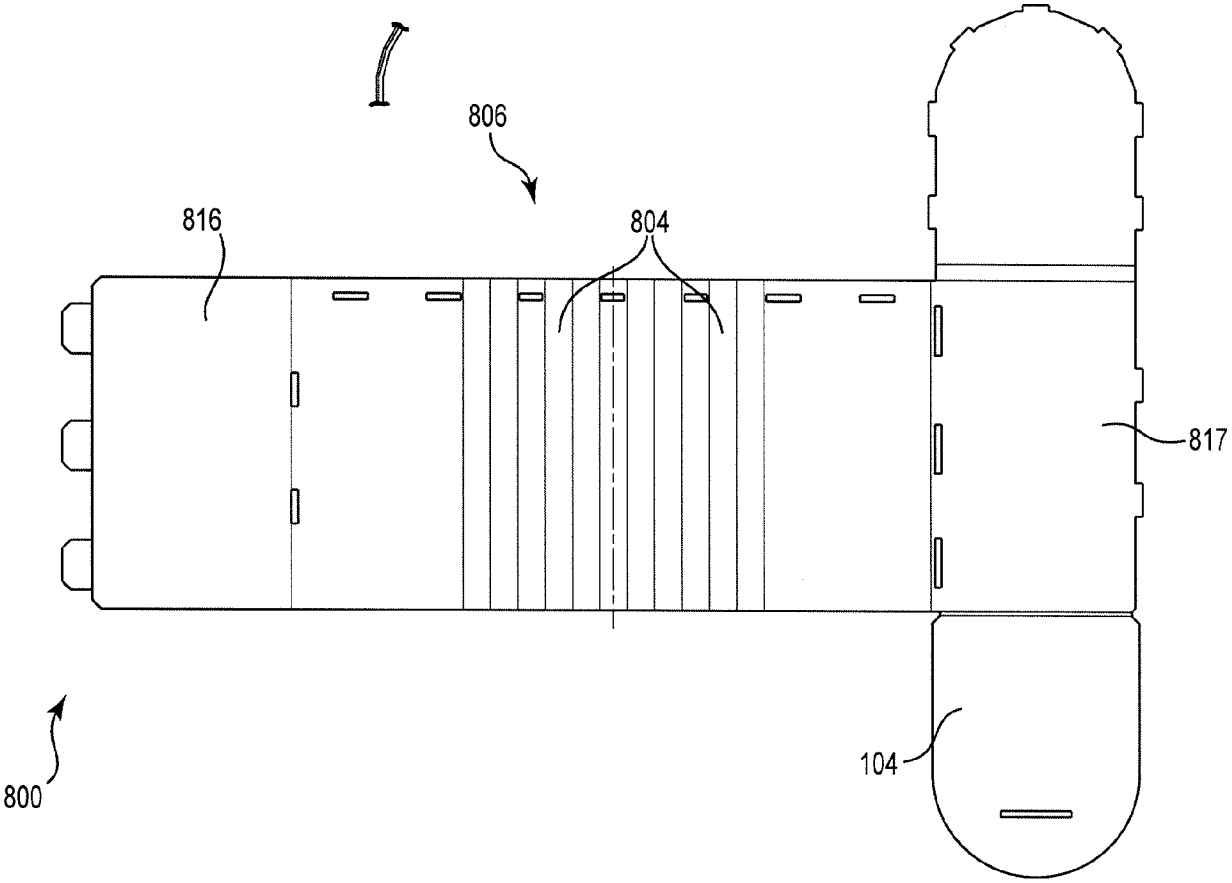
FIG. 8 illustrates a unitary blank for forming a receptacle including a two layer bottom panel design, in accordance with an embodiment of the present disclosure.

As shown in FIGS. 5-7, in some embodiments the bottom panel may be comprised of two layers, an outside bottom panel 516 and an inside bottom panel 517. The inside bottom panel 517 may be held in place by one or more retaining tabs that fit into slots on the side of the top panel. The outside bottom panel 516 may be held in position by one or more retaining tabs 576 that fit into receiving slots 578 on the top 506 panel of the receptacle as shown in FIGS. 5-7. The retaining tabs hold the receptacle generally tightly together. The retaining tabs may be of any suitable configuration including size and shape such that they may be compatibly received within the receiving slots. In some embodiments, the retaining tabs may be about 1 inch long, while in other embodiments they may be about ⅞ inch long, while in still other embodiments they may be bigger or smaller as desired. FIG. 8 provides an illustrative view of a unitary blank 800 for forming the previously described embodiment. Specifically, FIG. 8 shows an embodiment where the top has eleven facets 804, two bottom panels 816, 817 and wherein the top panel 806, two bottom panels 816, 817, and the door 104 are all comprised of the same unitary blank 800 of material. It will be understood, however, that variations to the pattern 800 are possible and within the spirit and scope of the present disclosure.

In another embodiment of a receptacle with a double paneled bottom, the outside bottom panel may be glued along the edge or otherwise affixed to the inside bottom panel to hold the box tightly together. In such an embodiment, the retaining tabs on the outside bottom panel and the corresponding slots on the top panel present in the previously described embodiment may be absent, while in other embodiments, the outside bottom panel may have the retaining tabs, and the top panel may have the receiving slots and may also be glued or otherwise adhered to the inside bottom panel.

Figure 9:
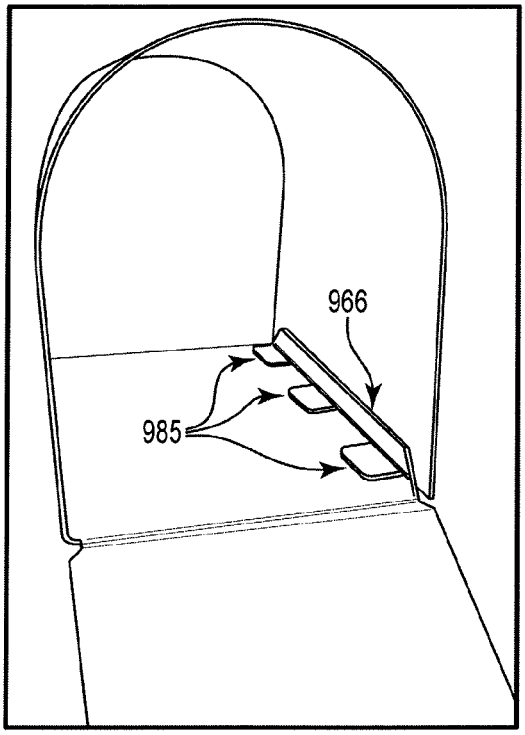
FIG. 9 shows the securing features for a receptacle according to one embodiment.
Figure 10:
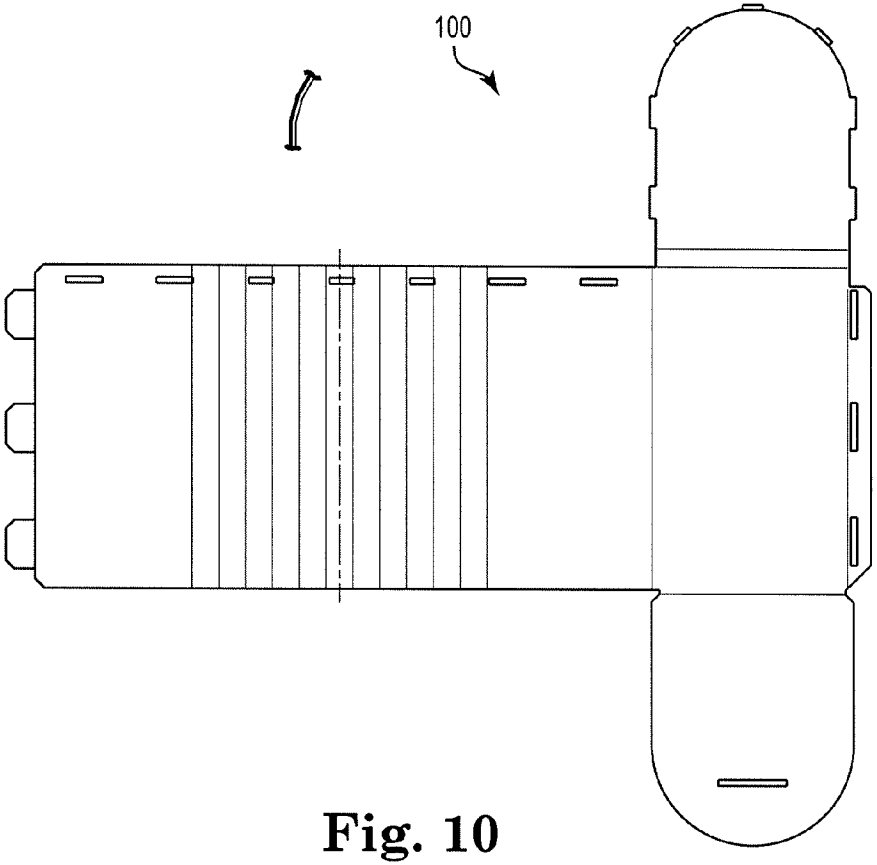
FIG. 10 illustrates a unitary blank for forming a receptacle according to one embodiment of the present disclosure.

In other embodiments, the bottom panel may be comprised of a single layer as opposed to a double layer. In such embodiments, the receptacle may be comprised of a unitary blank, or two or more cardboard pieces. It will be understood that while the embodiments disclosed herein are described as being comprised of cardboard, other materials are also contemplated and within the spirit and scope of the present disclosure. In a single bottom panel embodiment, one of the "sides" of the top panel that abuts and joins 160 the bottom panel 116 (as shown for illustrative purposes at FIG. 1) may have one or more folded locking tabs 985 that may be received into slots on a lap flange 966 as shown in FIG. 9. An illustrative view of a unitary blank 1000 for forming such an embodiment is provided as FIG. 10. Though it will be understood that modifications to the pattern 1000 may be made without departing from the present disclosure.

Figure 11:
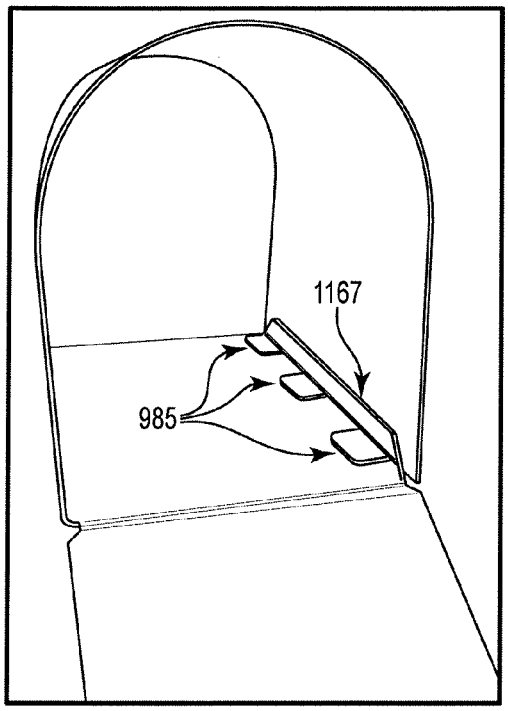
FIG. 11 shows the flange used to secure the receptacle according to one embodiment.
Figure 12:
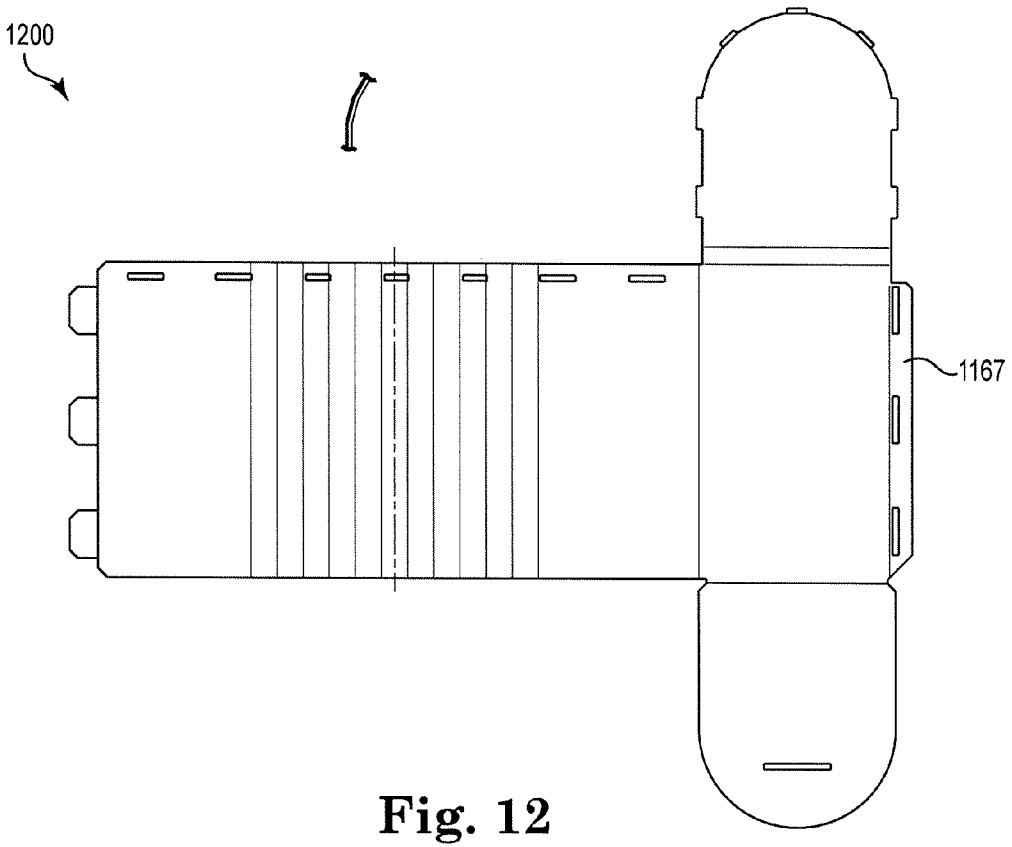
FIG. 12 shows a unitary blank for forming a receptacle in accordance with one embodiment.

Alternately, in another embodiment of a single bottom panel design, the "side" of the top may be glued to a lap flange 1167 that may run the length of the bottom box panel that may hold the box tight, as shown in FIGS. 11 and 12. FIG. 12 provides an illustrative view of a unitary blank 1200 including a lap flange 1167 that may be used to form the present embodiment, though modifications to the pattern 1200 may be made and are within the scope of the present disclosure.

Figure 13:
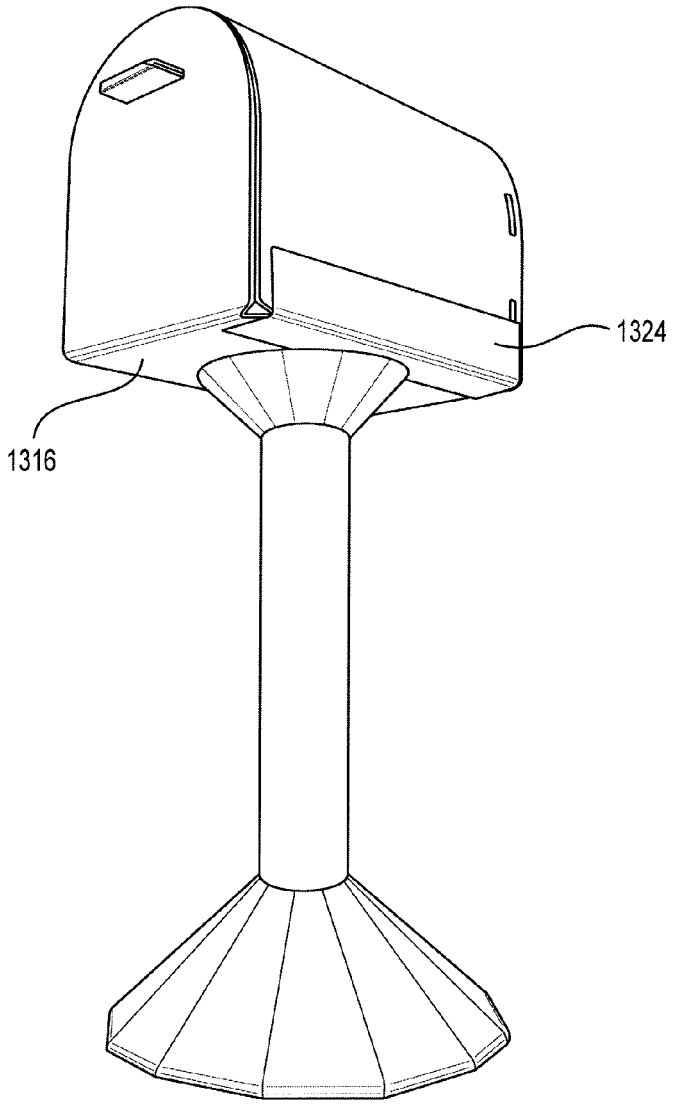
FIG. 13 shows another method of securing a receptacle according to another embodiment.
Figure 14:
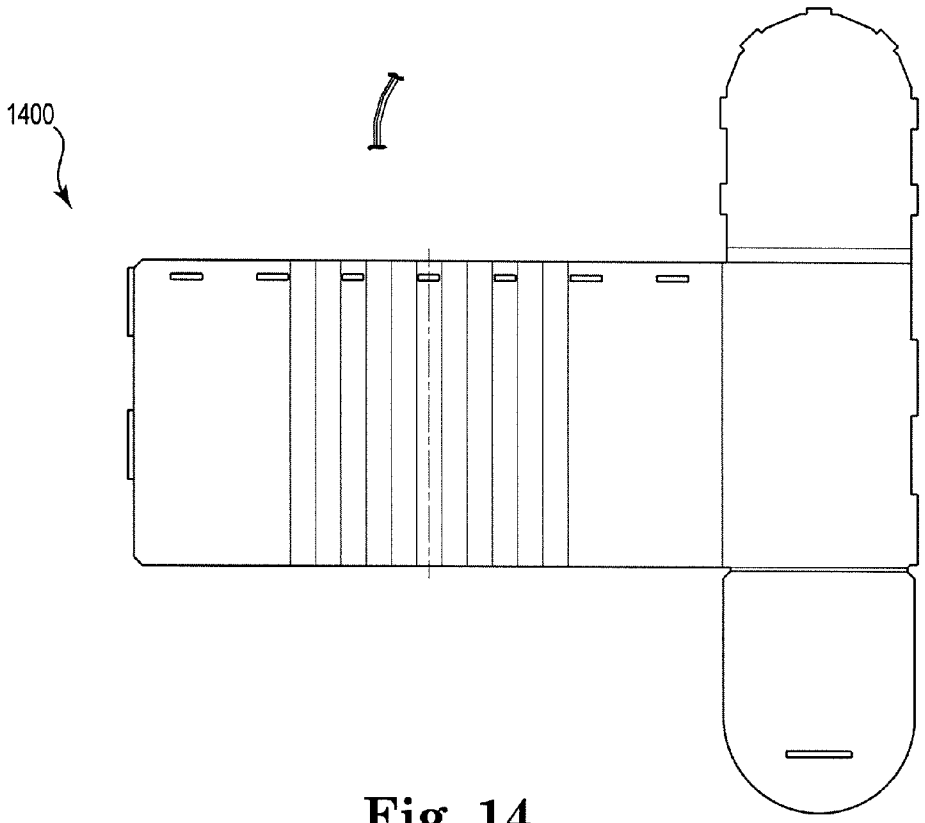
FIG. 14 shows a blank for making the embodiment of FIG. 13.
Figure 15:
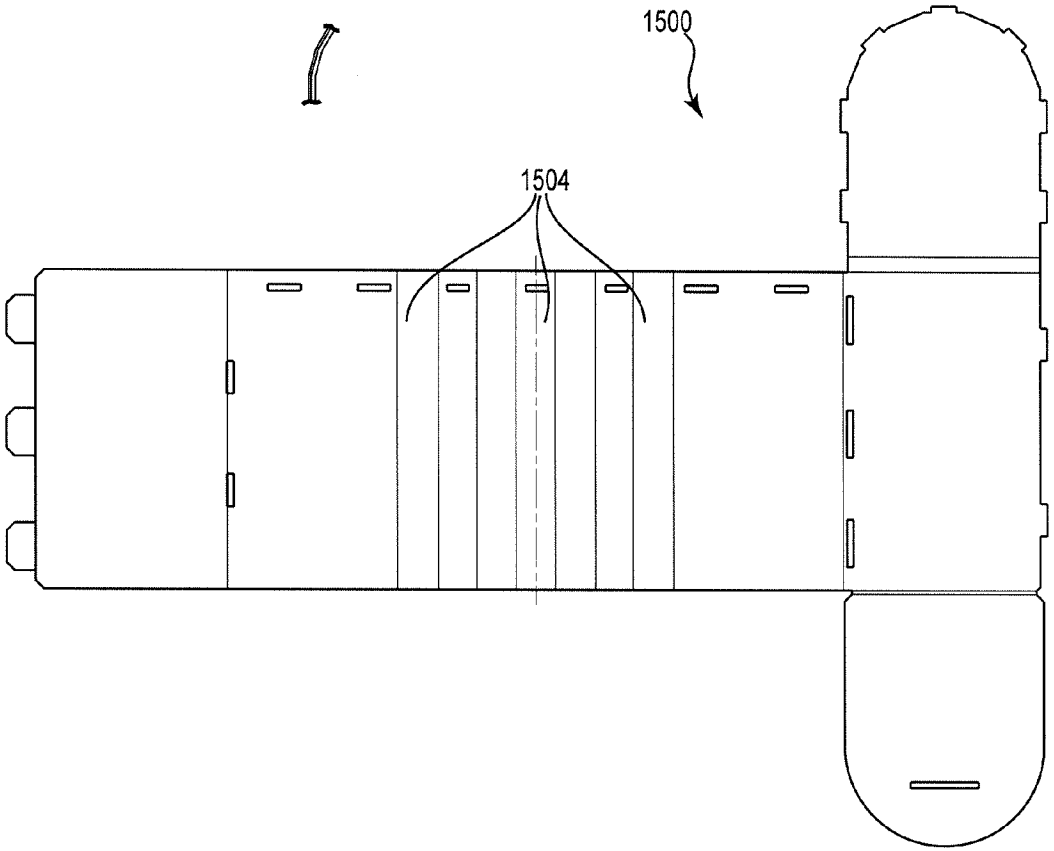
FIG. 15 shows a blank for making a seven-faceted top of a receptacle according to one embodiment.
Figure 16:
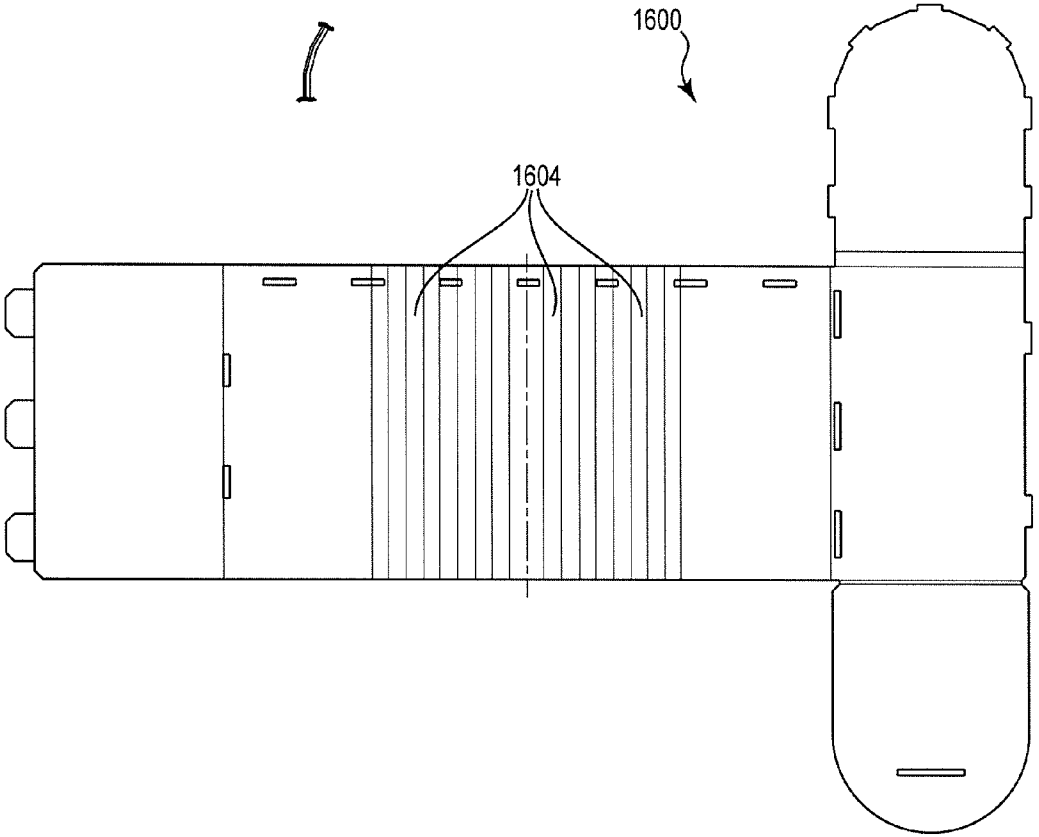
FIG. 16 shows a blank for making an 18-faceted top of a receptacle according to another embodiment.

In still another embodiment of a single bottom panel design, the "side" of the top 1306 may be taped 1324 or otherwise affixed to the single bottom panel 1316 as shown in FIG. 13. A unitary cardboard blank 1400 is provided as FIG. 14 as an illustrative view of a pattern 1400 that may be used to form such an embodiment, though modifications to the pattern 1400 are possible. For example, FIG. 15 provides an illustrative view of a unitary blank 1500 comprising a top with seven facets 1504, while FIG. 16 provides an illustrative view of a pattern 1600 with a top comprising eighteen facets 1604. As stated earlier, embodiments of the present disclosure include any combination of elements or variations of such elements described herein.

Figure 17:
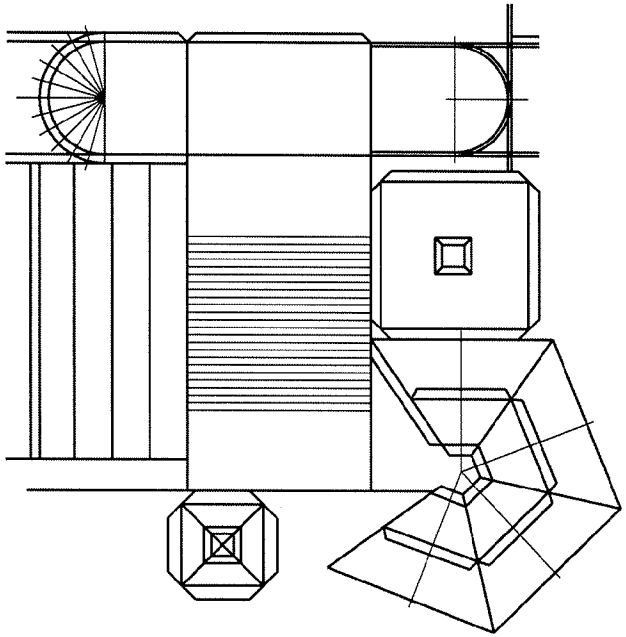
FIG. 17 provides a blank for forming a receptacle from more than one piece of material, in accordance with one embodiment.

While a faceted top has been disclosed, other embodiments are also possible, for example a receptacle may have a generally square top, or a generally smooth curved top. Further, as discussed above, some embodiments may be formed from two or more pieces of material. FIG. 17 provides an example of a receptacle formed from two pieces.

Mailbox Post Attachment

In some embodiments, a post attachment may be integral with the bottom panel of the mailbox receptacle. In other embodiments, the post attachment may come already formed and attached to the bottom panel. In still other embodiments, a user may form the post attachment and affix it to the bottom panel in any number of ways. The post attachment may be configured to be compatible with any suitable post. For example, some posts may be generally square shaped, rectangular shaped, cylindrically shaped, or have any other desired shape. Similarly, the post may have any desired width or circumference, and the post attachment may be compatibly configured to accommodate the size and shape of the post.

Figure 18:
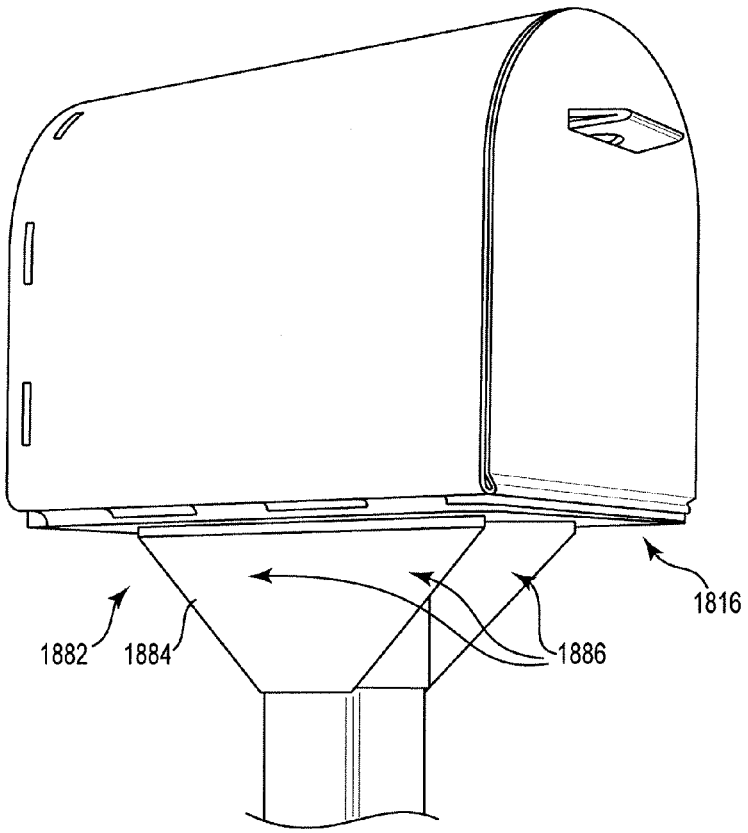
FIG. 18 shows a post attachment comprised of a unitary receptacle blank, according to one embodiment.
Figure 19:
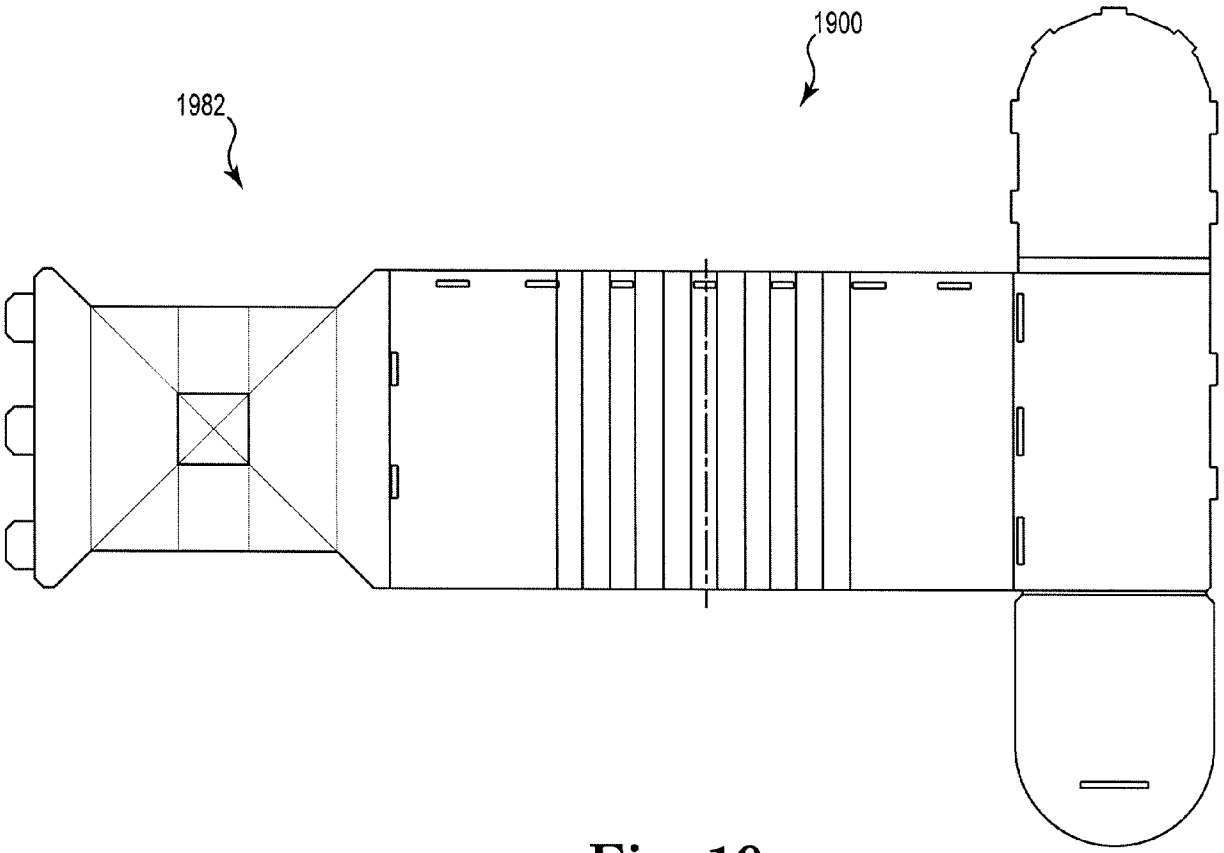
FIG. 19 shows a blank used to form a post attachment according to one embodiment.
Figure 20:
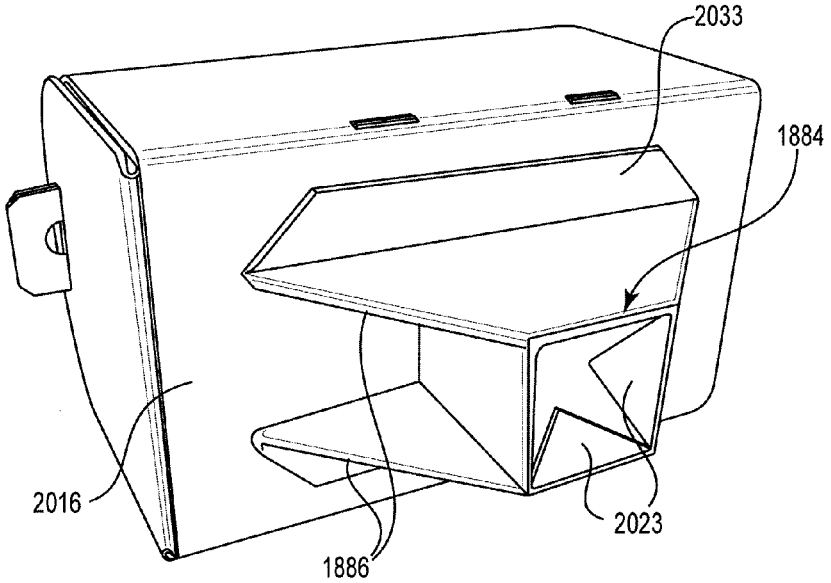
FIG. 20 illustrates beveled fold-in tabs according to one embodiment.

FIG. 18 shows an example of a post attachment 1882 that is formed from a unitary blank comprising a receptacle. The bottom panel 1816 has been formed to include a gusseted post attachment 1882. The gusseted post attachment 1882 may be formed in some embodiments from a generally rectangular section at the end of the blank for forming the receptacle. FIG. 19 provides an exemplary view of a unitary blank 1900 that may be used to form a receptacle including a post attachment 1982. As may be seen with reference back to FIG. 18, the post attachment 1882 when formed may result in a generally square shaped sleeve 1884 for receiving the post with four generally triangular gussets 1886. A novel and advantageous folding element of the post attachment of the present disclosure includes the beveled fold-in tabs 2023 shown in FIG. 20 that fold into the sleeve 1884. The tabs 2023 may generally create a tight interference fit with the post and present a clean friendly edge at the base of the sleeve 1884. The two reverse folds that create each of the four gussets 1886 also present a clean friendly edge while strengthening the gussets. The folded over gussets may be glued to add strength and stability. The flanges 2033 of the post attachment may be glued or otherwise suitably affixed to the bottom panel.

Figure 21A:
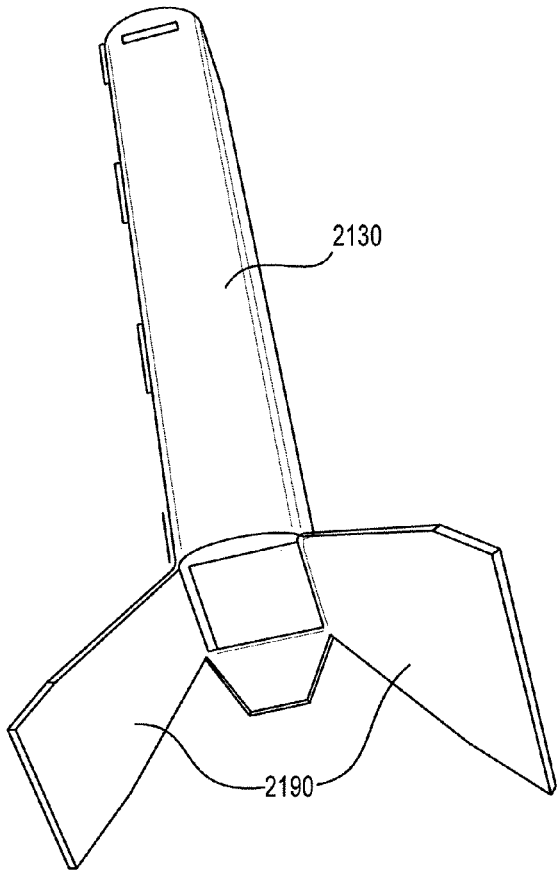
FIGS. 21A-21D show a post with connecting means and receptacle with attaching means and how the two may be coupled according to one embodiment.
Figure 21B:
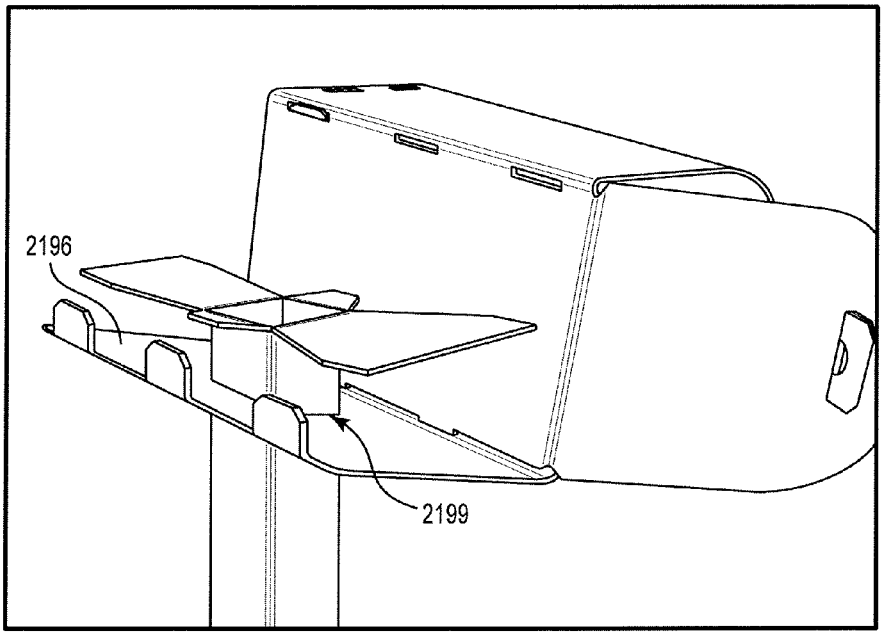
Figure 21C:
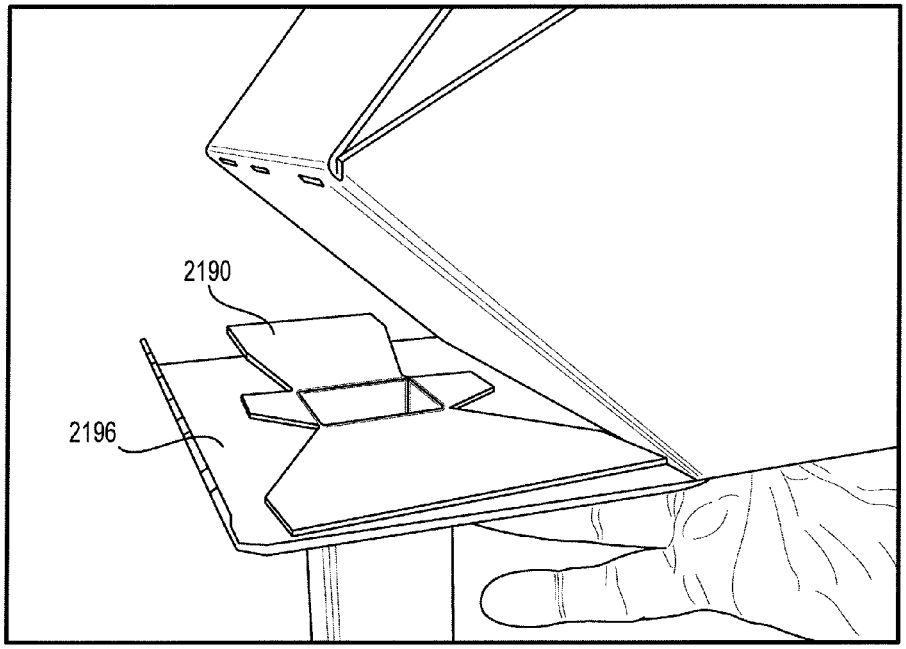
Figure 21D:
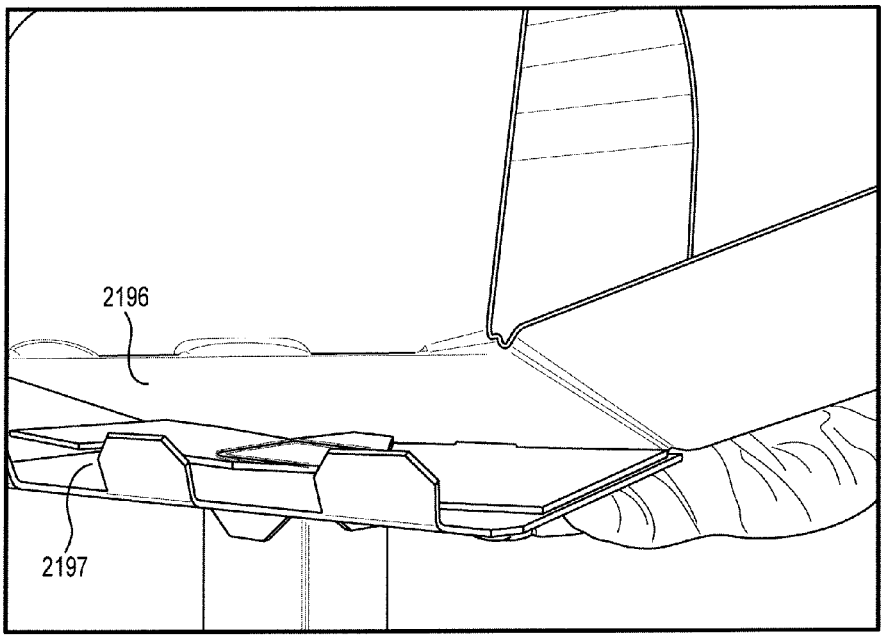

In other embodiments, the post attachment may include attachment components on the post as well as attachment components on the receptacle. FIG. 21A shows a post 2130 with connecting wing members 2190. FIG. 21B shows an outside bottom panel that functions as a post connecting member 2196 that may have a receiving space 2199 for the post to be positioned therethrough. The post connecting member 2196 may be positioned such that it abuts the post connecting wing members 2190, as shown in FIG. 21C. The receptacle may then be positioned such that the inner bottom panel 2196 and the outer bottom panel 2197 are flush with one another as shown in FIG. 21D. In some embodiments, the inner and outer panels may be glued together or otherwise adhered together, which may also include adhering the post connecting members to the inner and/or outer bottom panels.

Figure 22:
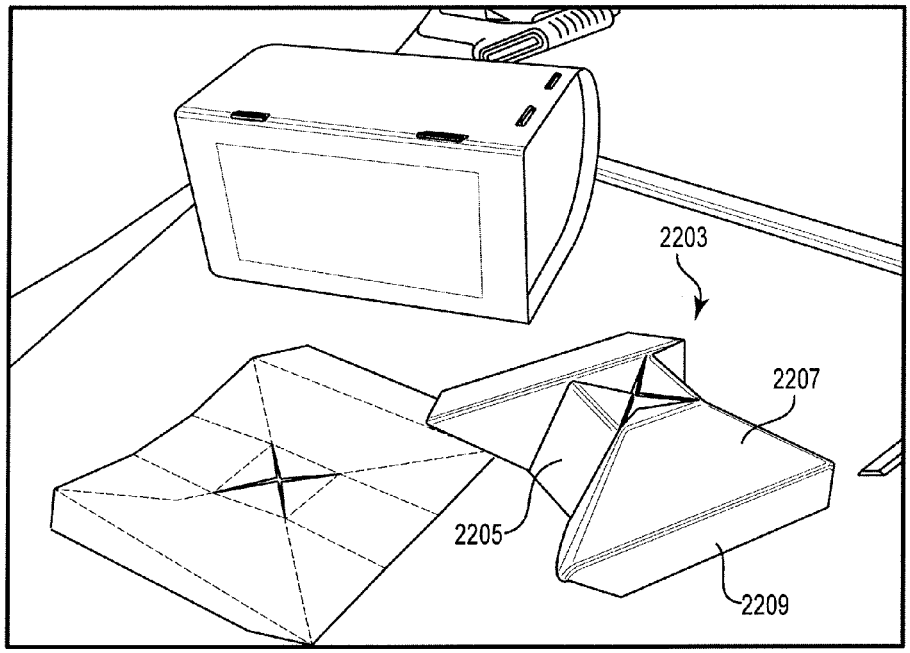
FIG. 22 illustrates an embodiment of a post attachment that is coupled to the receptacle according to one embodiment.

As previously explained, the post attachment may be formed separately from the receptacle and attached thereto. In one embodiment shown in FIG. 22, the post attachment 2203 may be formed from a generally rectangular piece of material to create a generally square sleeve 2205 with four triangular gussets 2207. The fold over gussets may be glued if desired to add strength and hold the shape of the post attachment. The post attachment may be centered on the bottom panel of the receptacle and glued thereon by one or more flanges 2209.

Figure 23:
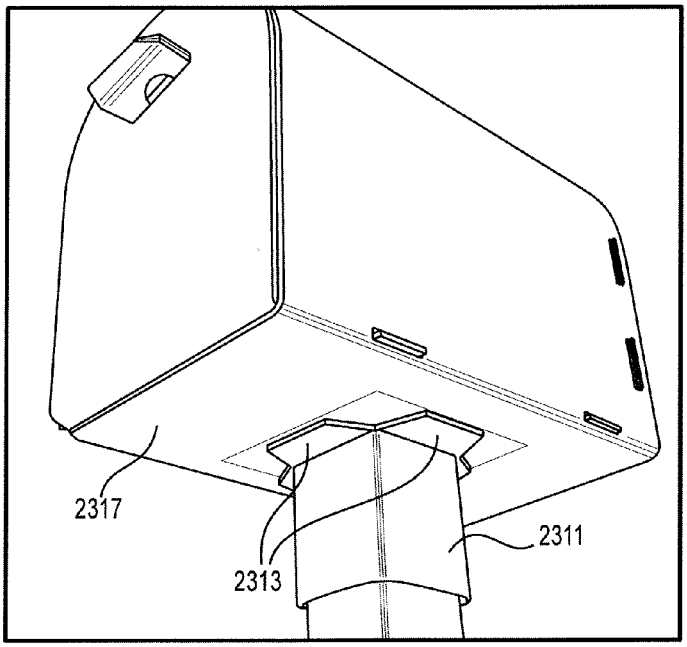
FIG. 23 shows another embodiment of a post attachment that is coupled to the receptacle according to another embodiment.

A post attachment 2311 may be formed as shown in FIG. 23. Such a post attachment may be formed from a piece of material to create a square sleeve with four gussets 2313 that radiate out from the post. The gussets 2313 may be glued or otherwise adhered to the bottom panel 2317 of the receptacle, so that the post attachment is generally centered on the bottom panel. Alternately, the gussets 2313 may fit into corresponding slots in the bottom panel and be folded down and glued or otherwise adhered to the bottom panel on the interior side of the receptacle.

Figure 24:
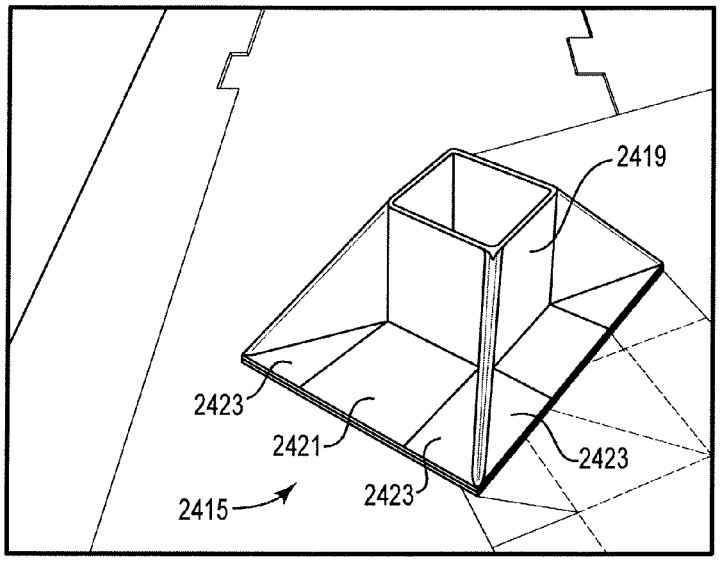
FIG. 24 illustrates yet another embodiment of a post attachment that is coupled to the receptacle.

In still another embodiment, a post attachment 2415 may be created as shown in FIG. 24. This post attachment may be formed from one shaped piece of material to create a square sleeve 2419 with four triangular gussets 2421. The post attachment 2311 may also include one rectangular attachment piece 2421 and two triangular attachment pieces 2423 on each of the four sides of the post attachment. The post attachment 2311 may then be glued on or otherwise adhered to the bottom panel of the receptacle by the eight triangular flanges 2423 and the four rectangular flanges 2421. The post attachment may generally be positioned and adhered to the center of the bottom panel of the receptacle.

Figure 25:
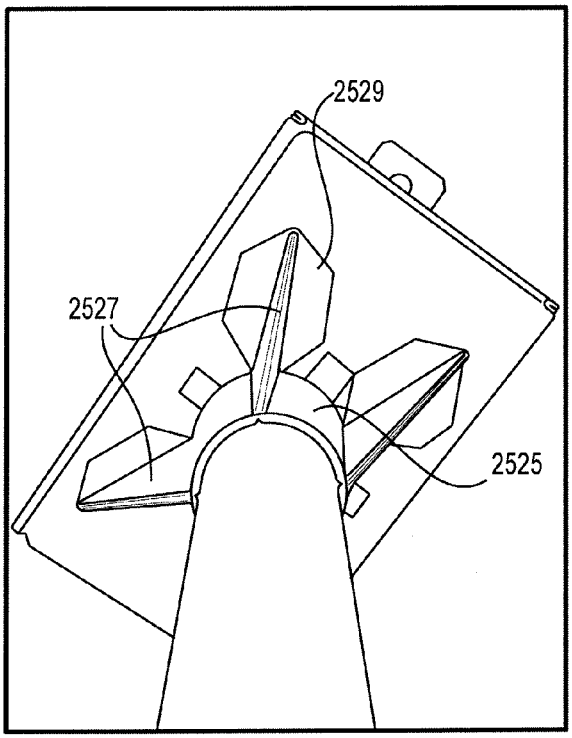
FIG. 25 illustrates still further another embodiment of a post attachment that is coupled to the receptacle.
Figure 26:
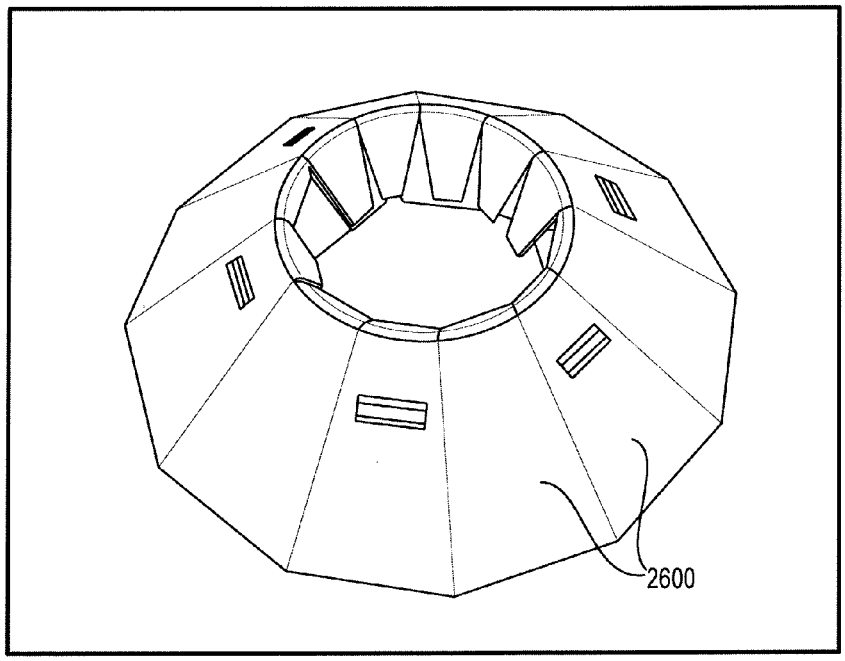
FIG. 26 illustrates another embodiment of a post attachment that is coupled to the receptacle.
Figure 27:
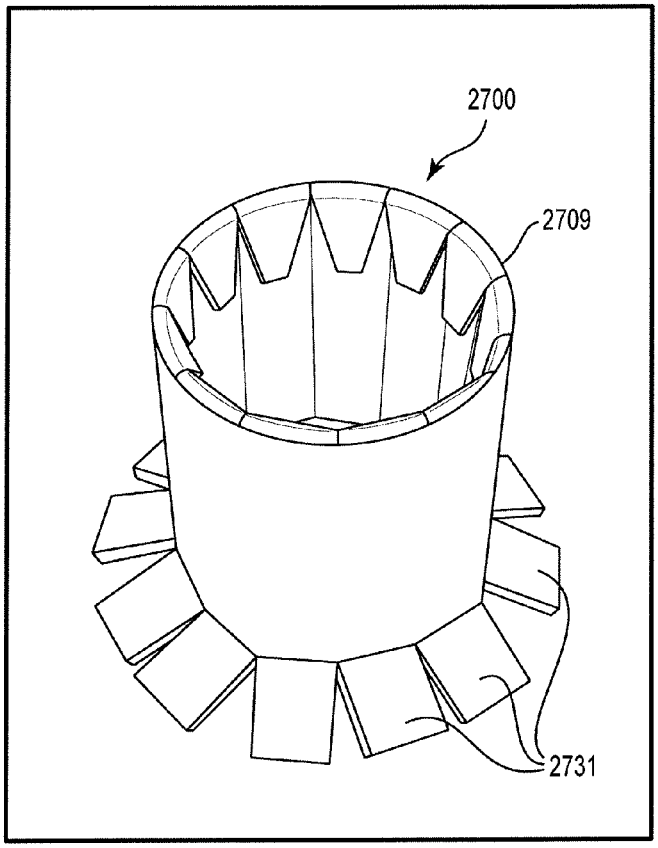
FIG. 27 illustrates yet another embodiment of a post attachment that is coupled to the receptacle.

Another embodiment includes a generally cylindrical receiving sleeve for receiving a generally cylindrically shaped post, as shown in FIG. 25. This type of post attachment may be formed from one piece of cardboard to create a cylindrical sleeve 2525 with four triangular gussets 2527 that radiate out from the post. The post attachment may include one or more flanges 2529 that may be glued to the center of the bottom panel of the receptacle. In still another embodiment, the post attachment 26 may be generally conical in shape as shown in FIG. 26 and may also be glued or otherwise adhered to the center of the bottom panel of the receptacle. While in still other embodiments, such as that shown in FIG. 27, the post attachment 2700 may have a cylindrical sleeve 2709 with a plurality of attaching flanges 2731 that may be glued or otherwise affixed to the center of the bottom panel of the receptacle.

Mailbox Door Handle and Closure

A mailbox handle and/or closure may be integral with or may be attached to the door of the mailbox. The handle may help allow a user to open the door, while the closure may help keep the door in a closed position, in some embodiments. The mailbox door itself may be comprised from a unitary blank including the other receptacle elements, while in other embodiments the mailbox door may be comprised of a separate piece(s) of material than the other elements of the receptacle. The door may be comprised of the same or different material as the rest of the receptacle. In such cases, the door may be attached to the receptacle by any suitable hinge, including, but not limited to a hinge comprising plastic, metal, piano hinge, paper tape, or any other suitable mechanism or combination of mechanisms.

The handle and closure for the mailbox door in some embodiments may be configured from a single piece of material, while in other embodiments it may be configured from two or more pieces. The handle and closure may be comprised of the same or different material than the rest of the mailbox.

Figure 28A:
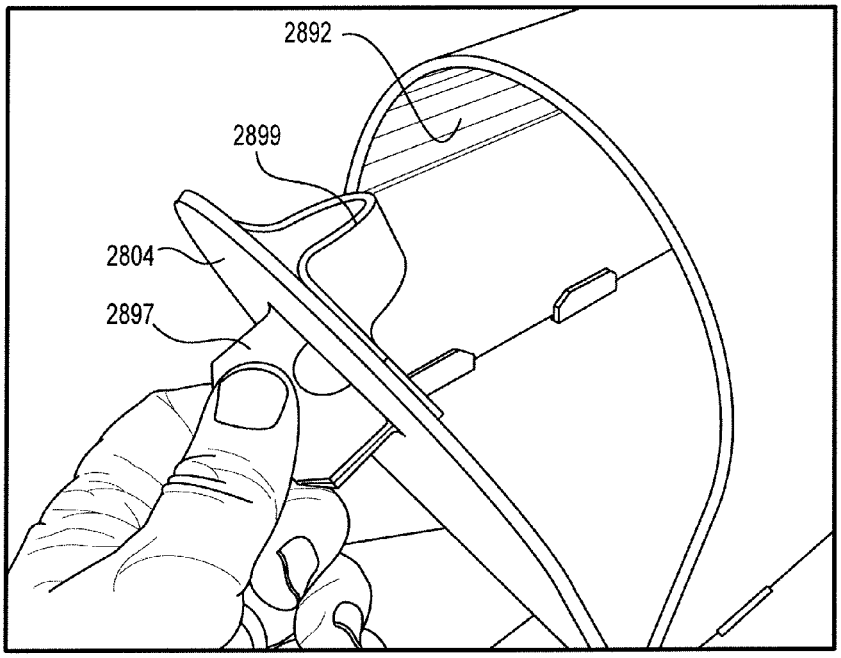
FIGS. 28A and 28B show a handle and closure according to one embodiment.
Figure 28B:
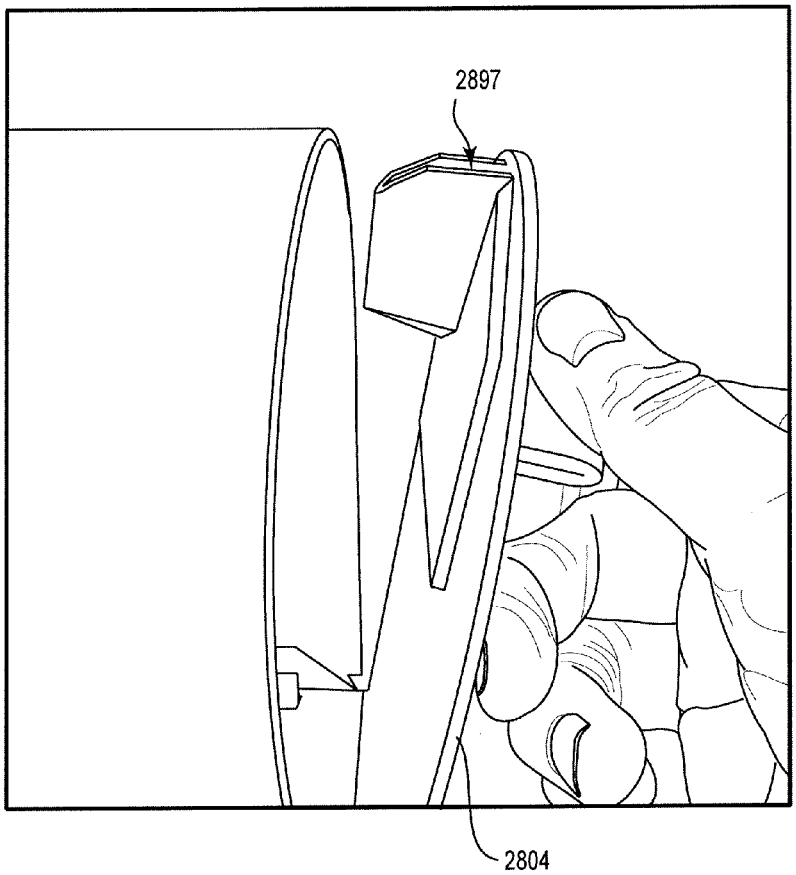

In one embodiment the handle and closure 2897 may be configured from one piece of material that may be glued in place in a slot on the receptacle door, as shown in. FIGS. 28A and 28B. A folded doubled-over vertical v-tab 2899 inside of the door 2804 may help keep the door shut by a friction fit with the inside top 2892 of the receptacle.

Figure 29A:
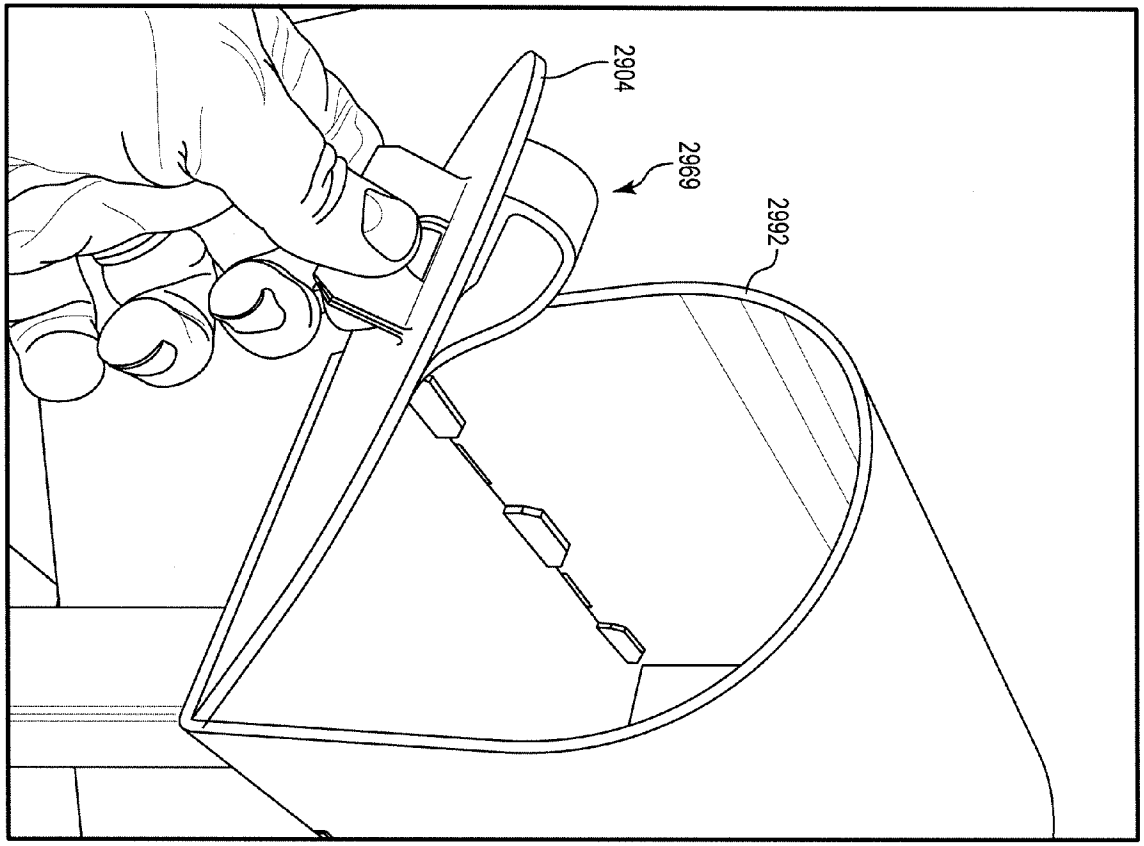
FIGS. 29A-29C show another embodiment of a handle and closure.
Figure 29B:
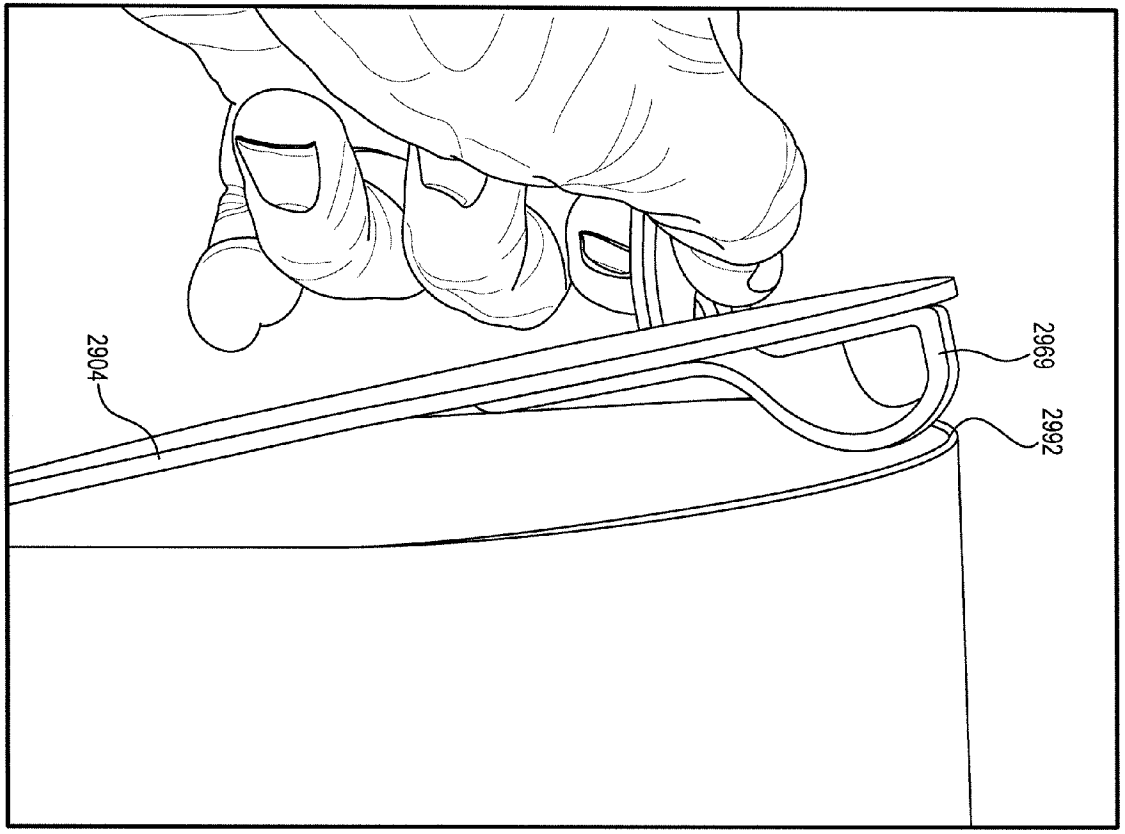
Figure 29C:
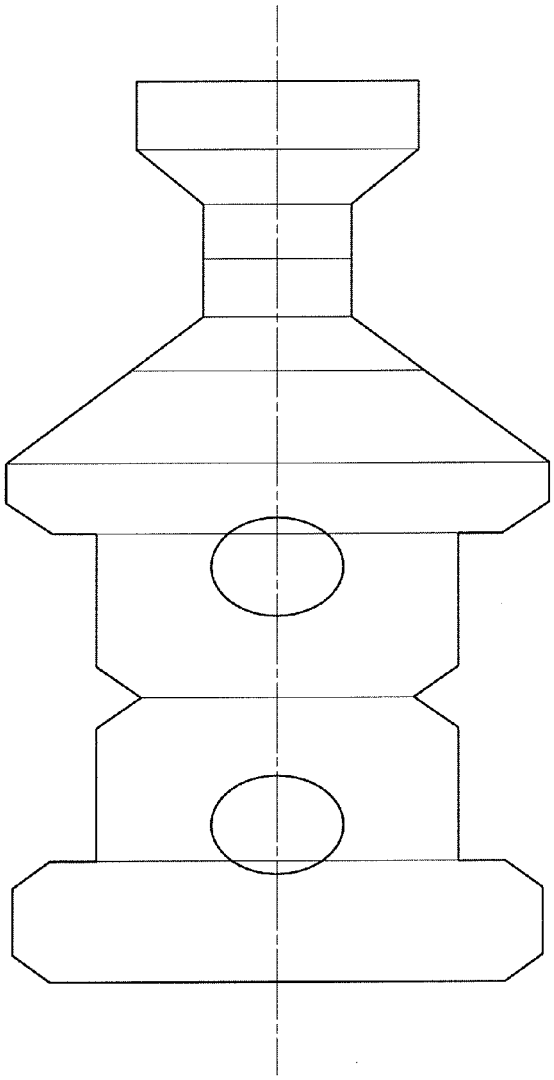

Another embodiment of a handle and closure may be seen in FIGS. 29A-29C. This handle and closure 2969 is comprised of one unitary piece of material and glued in place in a slot on the receptacle door 2904. The handle closure 2969 forms a folded over loop inside the door 2904 that acts to hold the door 2904 shut by an interference fit with the inside top 2992 of the receptacle.

Another embodiment of a handle and closure may be comprised of a single piece of material and glued in place or otherwise adhered to a slot on the door. A secure closure results from a tab that extends out from the front top center of the receptacle that fits generally snugly into a notch at the top center of the door. A beveled opening on the slot and mitered corners on the tab may help guide the parts into a friction fit that allows the door to be securely closed and easily operated.

In still other embodiments, the handle and/or closure may be comprised of two or more pieces that may be glued or otherwise adhered to the mailbox door. In some cases, the handle may include an eccentric closure, such as a beaded loop, a candy cane, a large button or any other item that may be desirably used as a handle. In some embodiments, the closure may comprise Velcro or the closure may be a magnetic closure, or any other suitable and desirable closure mechanism.

Mailbox Post

As previously explained, the post of the mailbox may have any suitable and desired geometry including size and shape. For example, the post may be cylindrical, rectangular, octagonal, triangular, or any other suitable shape. The post may have any suitable and desired height. For example the post may be about two feet high for use with small children, or the post may be approximately three feet high for older kids. Though it will be understood that the post may have any suitable height. The post may be comprised of the same or different material than the other elements of the mailbox. Further, the post may be comprised of one or more pieces of material.

Figure 30:
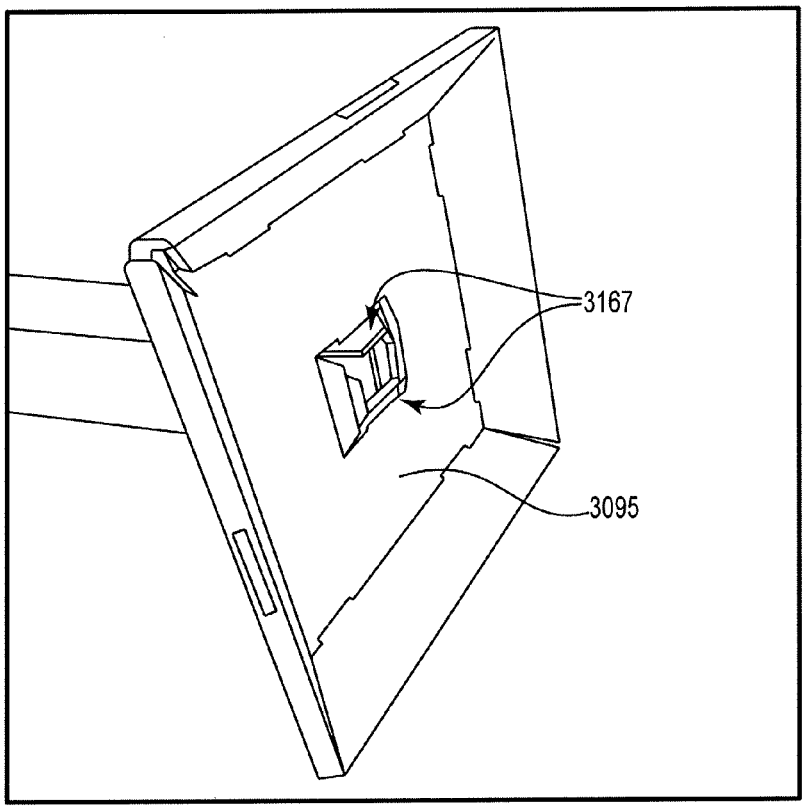
FIG. 30 shows the use of locking teeth according to one embodiment.
Figure 31:
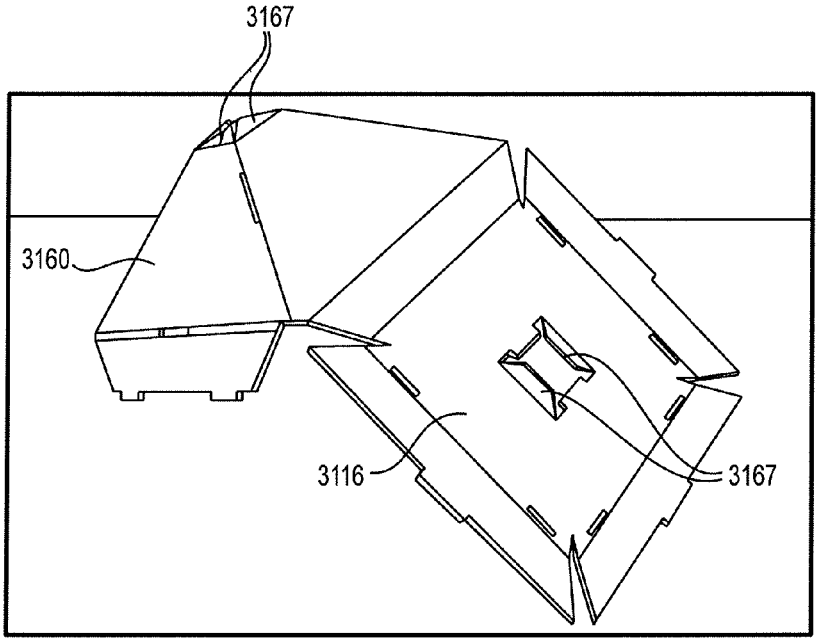
FIG. 31 illustrates a pyramid base according to one embodiment.

A mailbox post in one embodiment may be comprised of one piece of material that has five vertical panels that may form a generally square shaped post. Accordingly, one of the four sides of the square shaped post will be comprised of two layers of material as the fifth vertical panel will lay on top of the first panel to form a square shape. Beveled folded tabs on the opposite ends of the post that connect on the one end to the post attachment, and on the other end to the mailbox base 3095 (shown in FIG. 30), facilitate sliding the post into the post attachment and the base (respectively). Any suitable number of tabs may be used. Alternately, in another embodiment, instead of tabs, the fifth and the first panel of the post may be glued or otherwise adhered to one another. Two slots on opposite sides of one end of the post may allow the post to snap in place with corresponding locking teeth 3167 in the bottom panel 3116 of the base and similar locking teeth 3167 in the pyramid portion of the base 3160, as shown in FIG. 31.

Figure 32:
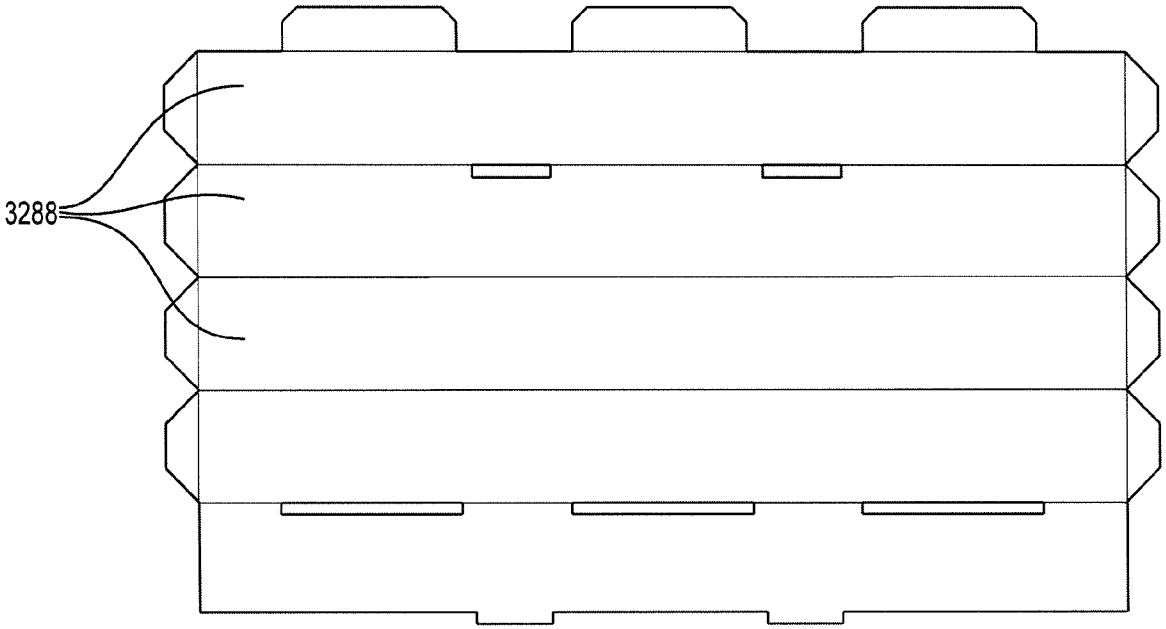
FIG. 32 shows a blank that may be used to make a post according to one embodiment.

In an alternate embodiment, a post may be formed from a unitary piece of material comprising four vertical panels 3288 and a glue flange as shown in FIG. 32 to form a generally square post. In this embodiment, the post may not include locking tabs on panels or teeth as the panel is instead glued in place with a flange. The ends of the posts may have beveled folded tabs for attaching to the post attachment and the base as described in the previous embodiment.

In another embodiment, the post may be a cylindrical tube formed from one piece of material Another post embodiment may be comprised of two or more pieces of material. In one case, a post may be made from three pieces of material. Each section of the post is folded from one piece of cardboard with five vertical panels that form a solid square post section. The sections may be held together with the "post coupling" made from one rectangular piece of cardboard.

On each section of the post, one short tab on the inside panel (panel #1) fits into a slot along the 4th fold on panel #4. The outside panel (#5) has 2 longer folded tabs that slide into 2 slots along the fold (fold #1) on the inside panel (panel #1) holding the leg tube tight. Four beveled folded tabs on one end of the post allow the post to slide into the pyramid base or post gusset. Two slots on opposite sides of one end of each post section allows one of them to snap in place with two corresponding teeth in the bottom base. Beveled folded tabs on the opposite ends of the post sections may be folded inside and have square punch-outs to fit the post coupling and lock it in place to create one continuous post.

The "post coupling" may be made from one rectangular piece of cardboard with seven alternating parallel folds that form an X cross-section. Notches in the edges of the "post coupling" result in teeth that snap in position when inserted into the corresponding ends of the (2) post sections.

Mailbox Base

The mailbox base may couple to the post and provide support and stability and literally ground the mailbox. The base may be comprised of the same or different material than the rest of the mailbox elements. The base may be formed from a unitary piece of material or in other embodiments, it may be formed from two or more pieces that may or may not be the same material. The base may take any desired shape such that it may compatibly receive the end of the post. For example, the base may be conical, pyramid shaped, octagonal, or have any other desired shape.

A relatively small sized mailbox, for example a mailbox sized for easy use by children under 7 years of age, may be inherently stable assuming relatively normal or usual mailbox proportions. However, in some cases, increasing the height of the mailbox for older children or adults, for example, may result in a relatively less stable unit, in some cases. Accordingly, some embodiments may include the following features to increase the stability of the mailbox: a ballast may be added to the base via beans, putty or any other dense fluid material, for example that may fit into the void of the base; the base may be enlarged to increase stability mechanically and allow for more ballast; the base or other advantageous part of the mailbox may be attached to another part of an overall display, for example; and/or the base may be attached to the floor or other substrate with adhesive, tape or other fastening devices, such as nails, Velcro, clamps, or any other suitable securing mechanism.

Figure 33A:
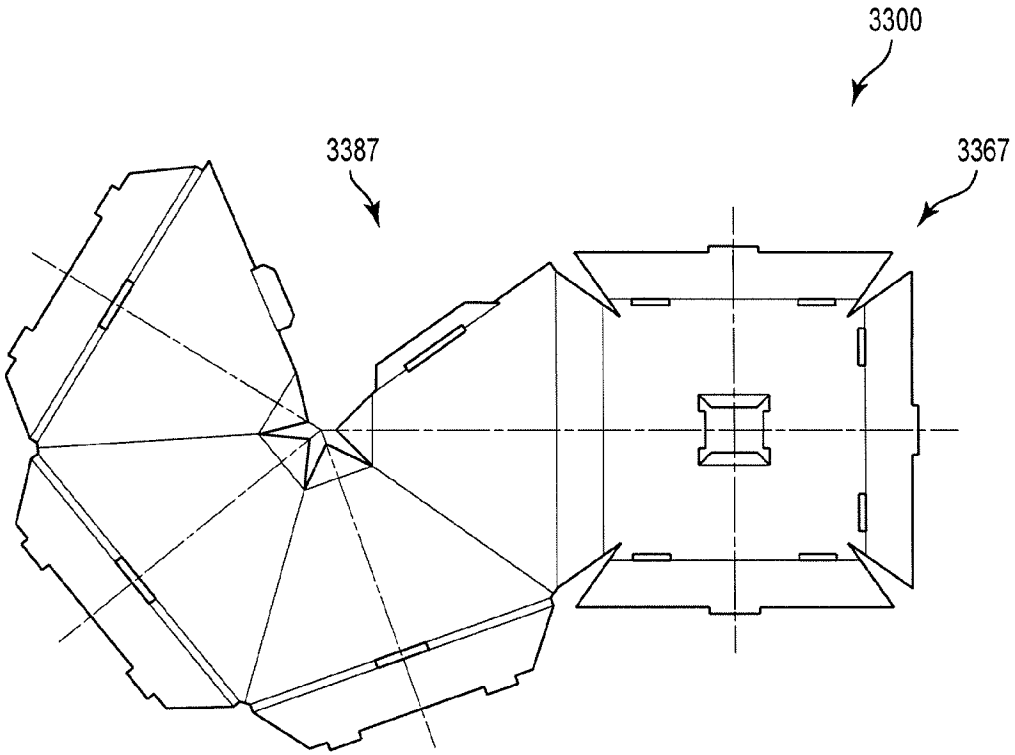
FIGS. 33A-33D illustrate one embodiment for forming a base.
Figure 33B:
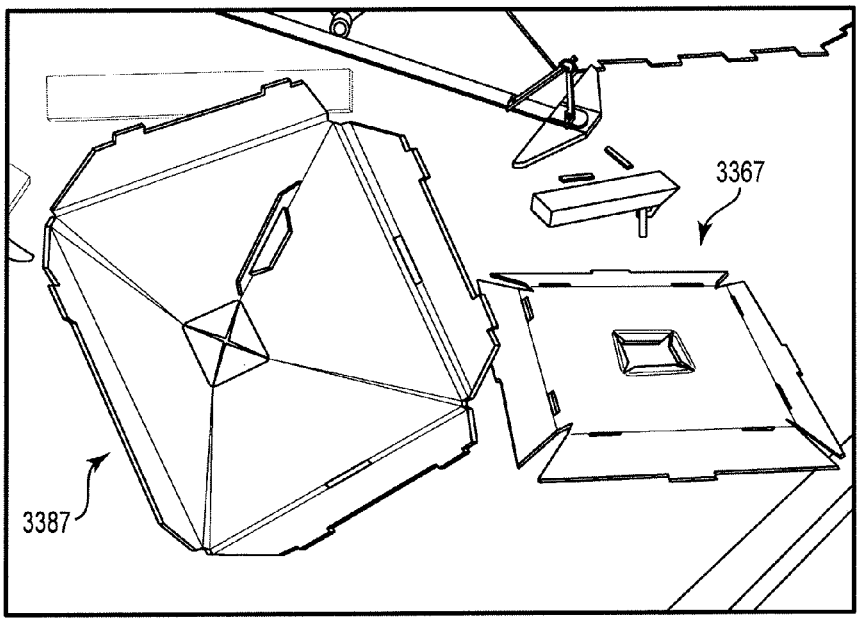
Figure 33C:
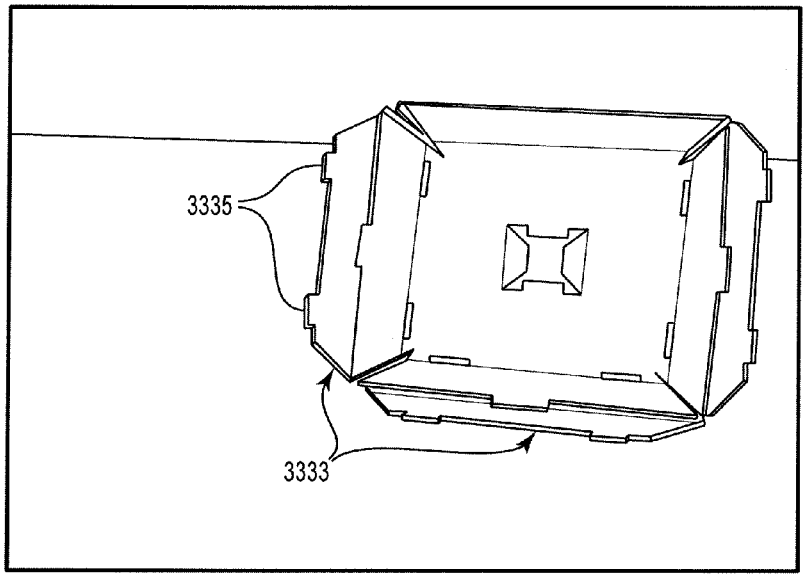
Figure 33D:
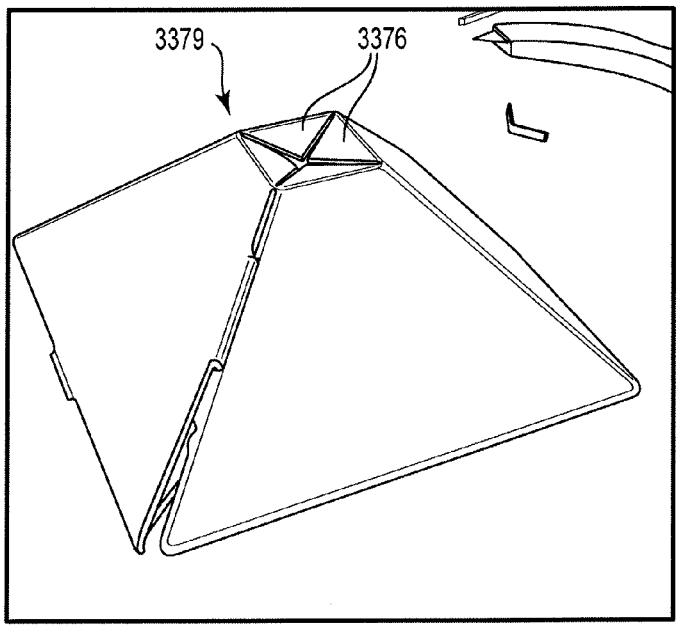

In one embodiment a pyramid shaped base may be constructed from a unitary piece of material 3300 as shown in FIGS. 33A-33D. As may be seen in FIG. 33B, the outer pyramid 3487 may wrap around and be held together with a folded tab and slot on opposite ends. In an alternate embodiment, instead of tabs and slots, the outer pyramid may be secured by glue or another adhesive. In addition to the outer pyramid 3387, the base may also comprise a bottom support panel 3367. The inside bottom panel may fold under and be captured by tapered flanges 3333 at the bottom of the pyramid as shown in FIG. 33C that may fold under and in some cases be glued in the seam corner. One or more tabs 3335 on the tapered flanges may snap into corresponding slots on the bottom support panel 3367 to position the two pieces and provide strength to the mailbox and a smooth rim around the bottom of the pyramid. FIG. 33D provides a view of a constructed pyramid base of the present embodiment. As may further be seen in FIG. 33D, the top of the base at the post opening 3379 includes beveled fold-in tabs 3376 to provide a tight fit with the post and clean edges at the top of the base. An opening at the center of the inside bottom panel 3367 includes two beveled fold-in tabs on opposite sides and two retaining teeth on the remaining sides that may snap into corresponding slots at the bottom end of the post to lock in in place. It will be understood that any reference to a specific number of tabs, teeth, slots, etc. is used in reference to a particular embodiment, but obvious variations of such elements including the number thereof (i.e. tabs, slots, teeth of any size, shape, and number) is within the spirit and scope of the present disclosure.

Figure 34A:
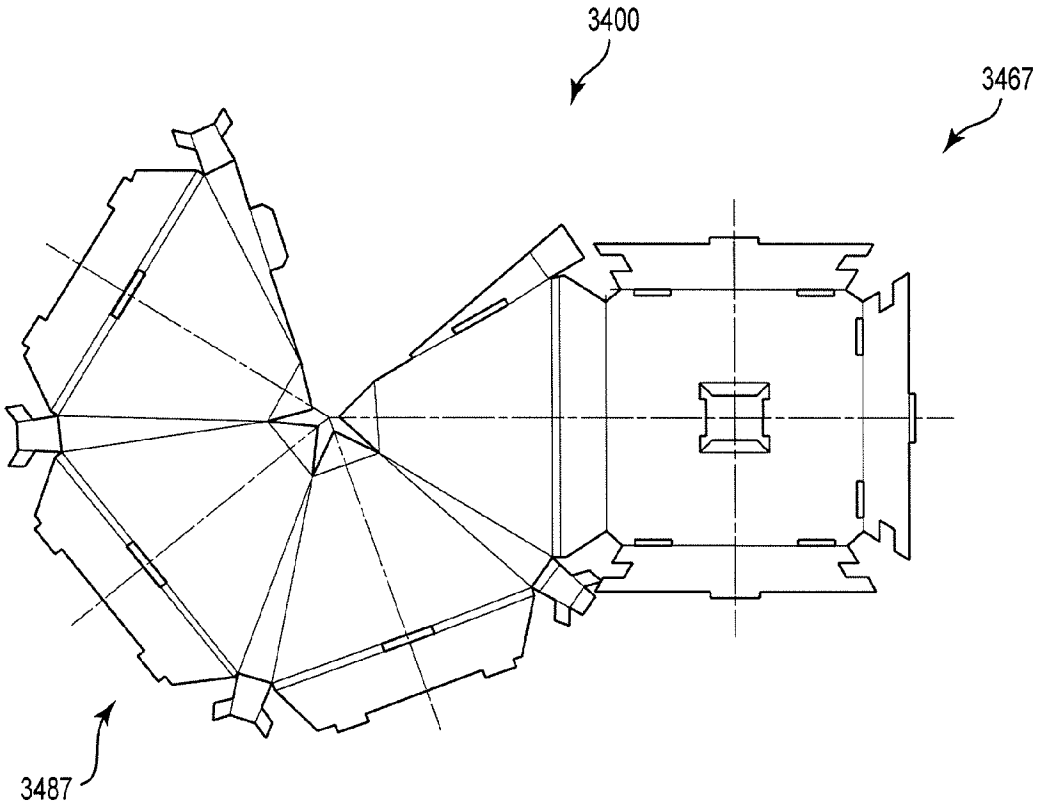
FIGS. 34A-34C show another embodiment for forming a base.
Figure 34B:
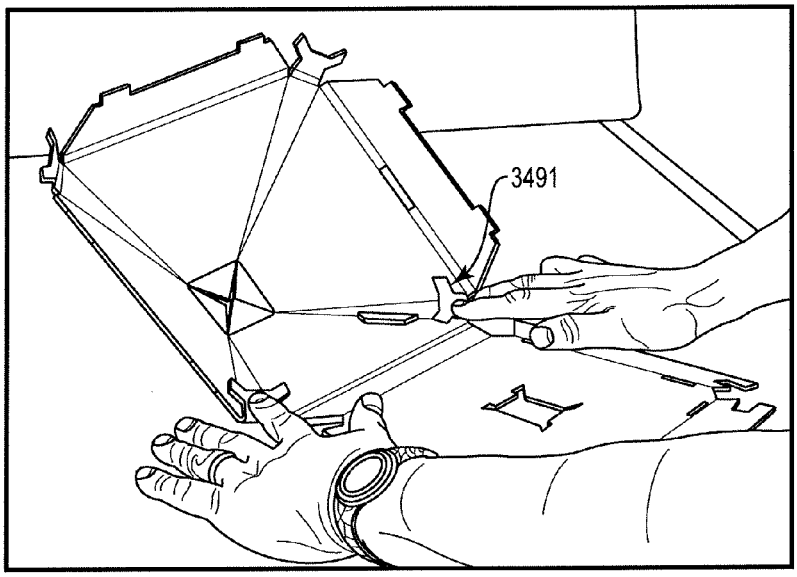
Figure 34C:
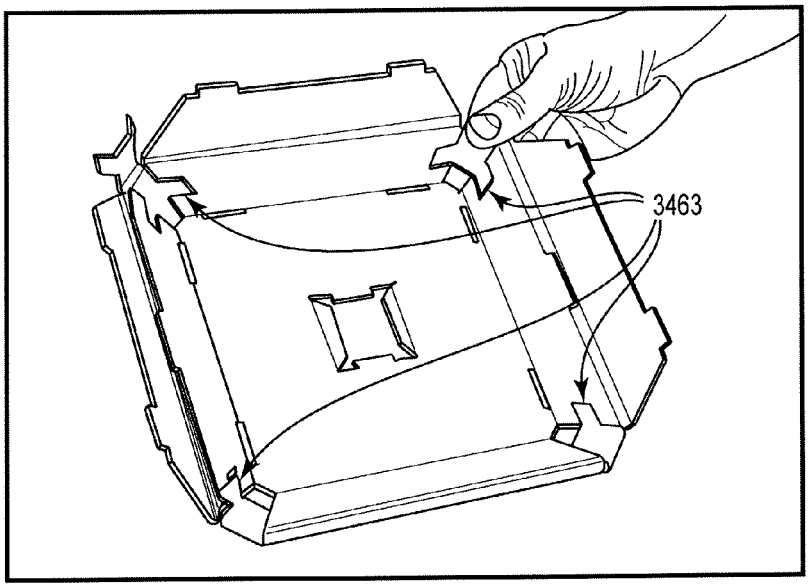

In another embodiment, a base may be a pyramid comprised of a unitary piece of material comprising an outer pyramid 3487 and bottom support panel 3467 as shown in FIG. 34A. The mitered pyramid base may wrap around and be held together with a folded tab and slot on opposite ends 3491 shown in FIG. 34B. Winged fold down corner tabs 3463 may be positioned in the notched perimeter flanges on the inside bottom panel that may fold under and be captured by tapered flanges at the bottom of the pyramid that fold under as shown in FIG. 34C. Further tabs on the tapered flanges may snap into corresponding slots on the bottom support panel to position the two pieces and provide added strength to the structure.

Figure 35:
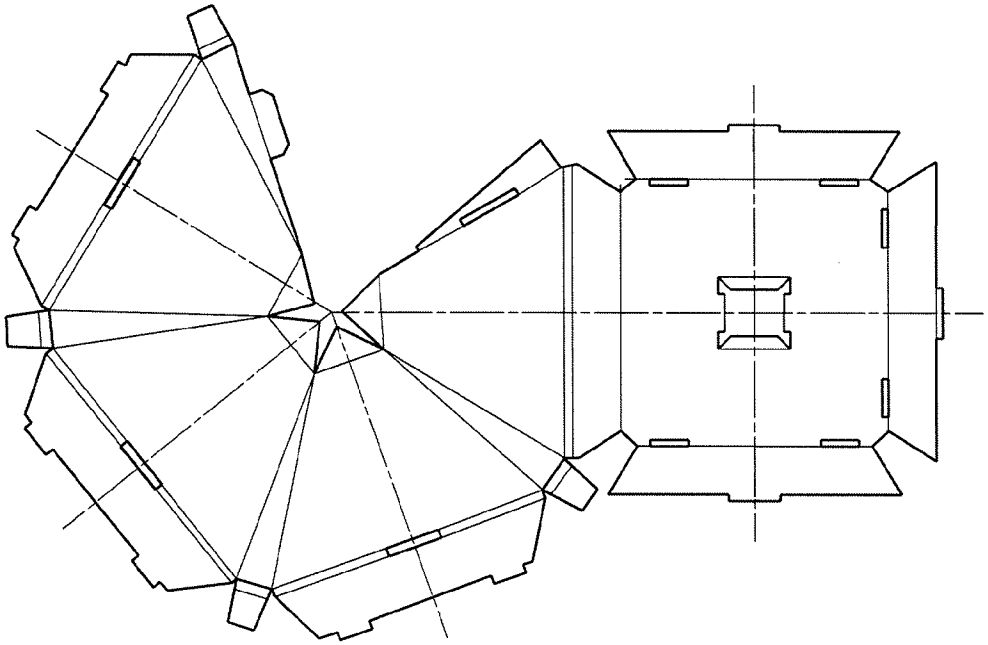
FIG. 35 shows a blank that may be used to make a base according to one embodiment.
Figure 36:
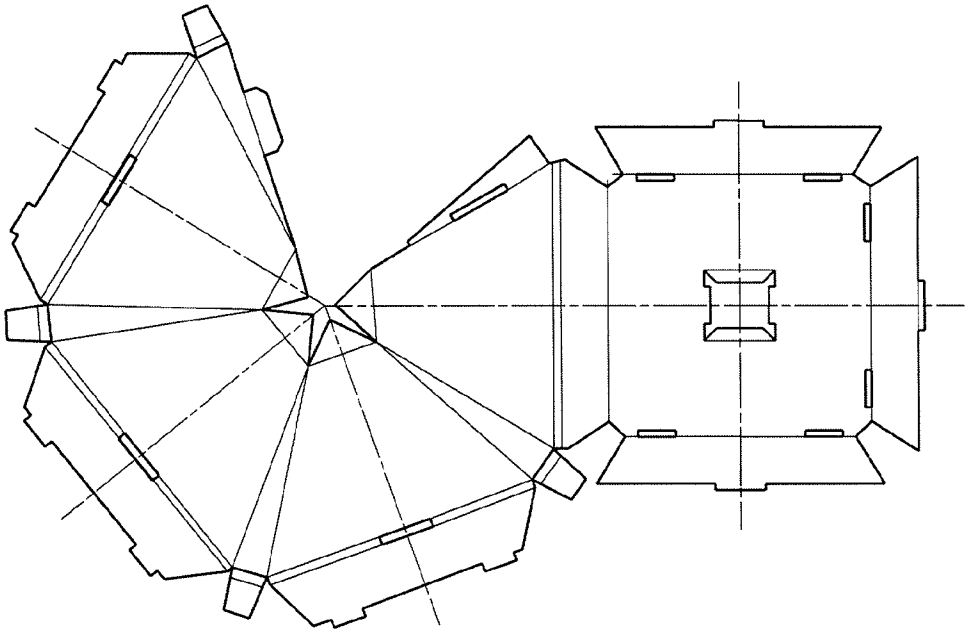
FIG. 36 shows a blank that may be used to make a base according to another embodiment.

FIGS. 35 and 36 provide yet additional embodiments of pyramid shaped bases that may be comprised of a unitary piece of material. As has previously been stated, each of the blank patterns provided herein represent particular embodiments as well as examples of the types of patterns that may be used to form elements including obvious variations of aspects of each design.

Figure 37:
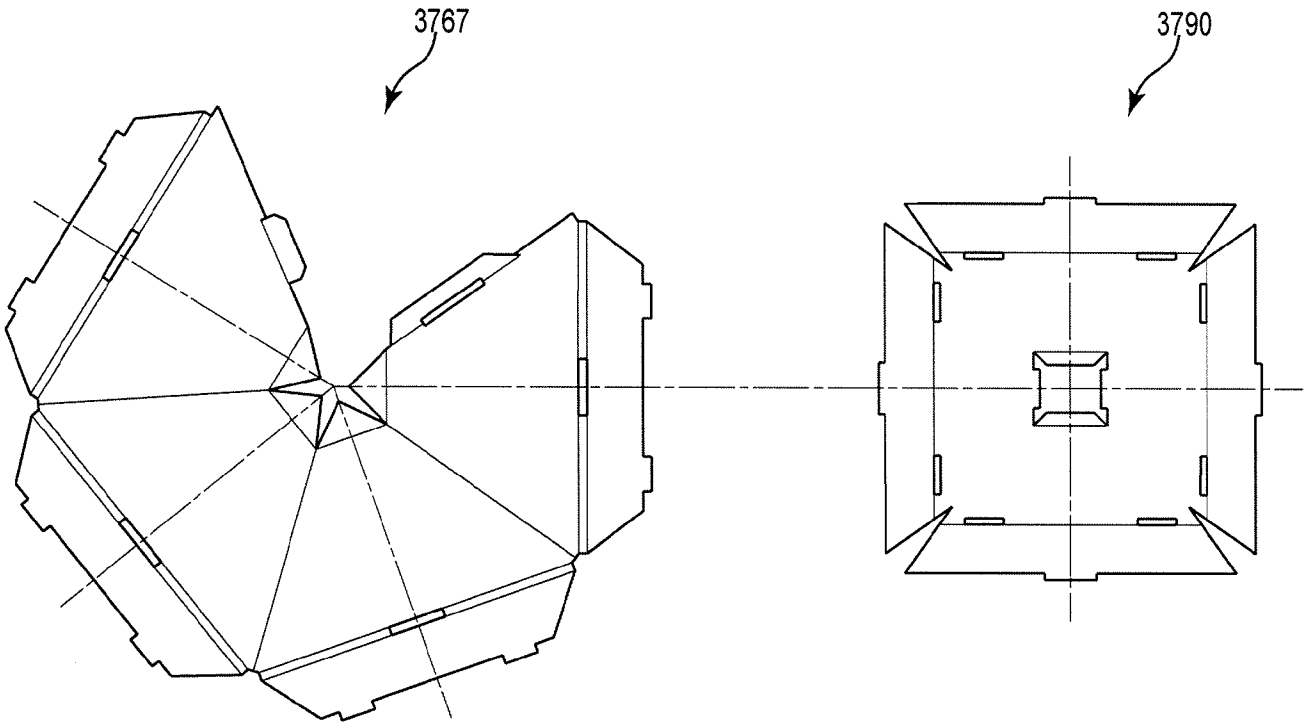
FIG. 37 shows a blank that may be used to make a base according to another embodiment.

In alternate embodiments the base may be comprised of two or more pieces of material. As may be seen in FIG. 37, the pyramid 3767 may be formed separately from the bottom support panel 3790. As with other embodiments, the outer pyramid may wrap around and be held together with folded tabs and slots on opposite ends, or in other embodiments, the ends may be glued or otherwise adhered to one another. The square inside bottom support panel may have flanges on all four sides that may be captured by tapered flanges at the bottom of the pyramid that fold under and may be spot glued. A plurality of tabs on the tapered flanges may snap into corresponding slots on the bottom support panel to position the two pieces and provide strength to the structure.

Figure 38A:
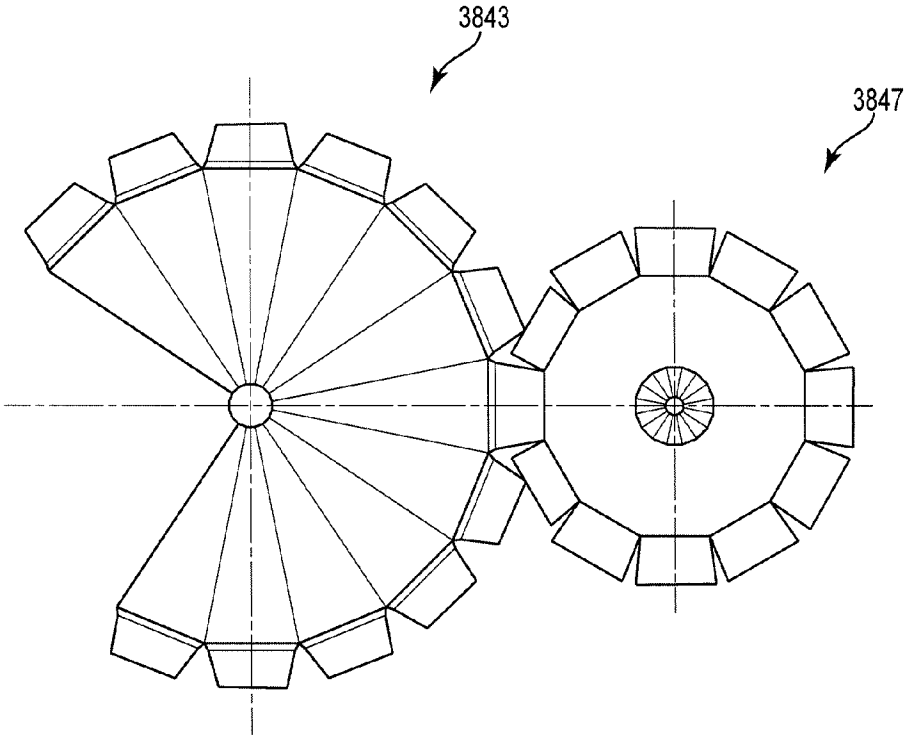
FIGS. 38A-38C illustrate another embodiment of a base that may be used in accord with the present disclosure.
Figure 38B:
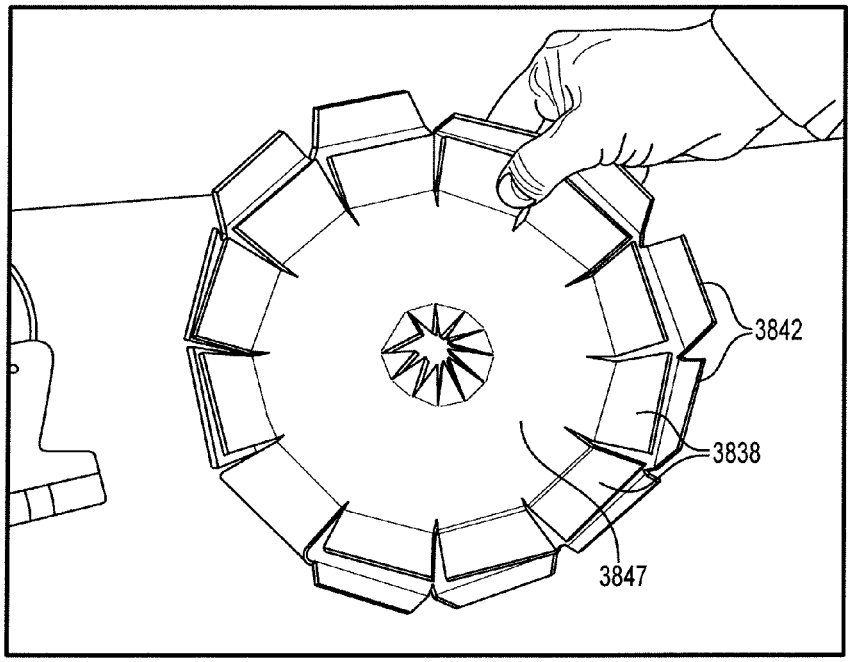
Figure 38C:
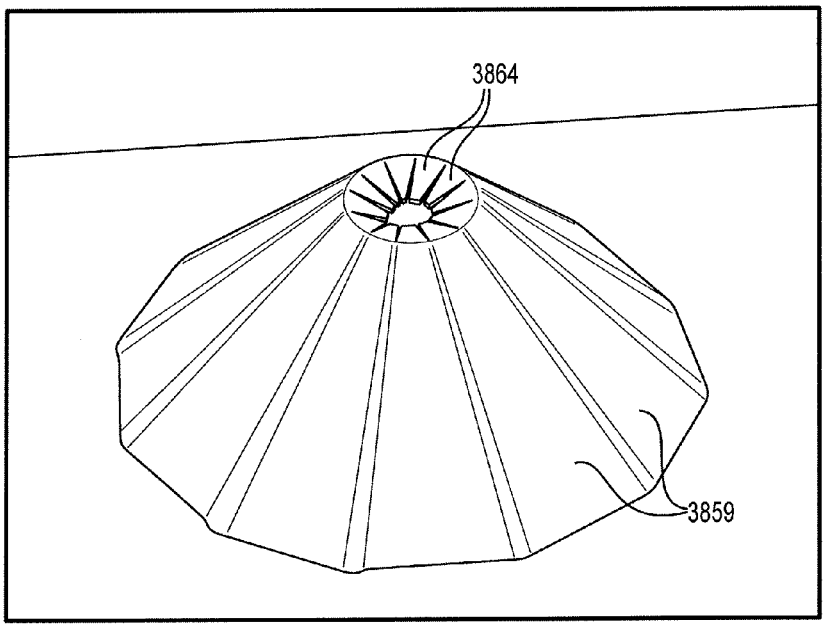

In another embodiment, the base may be conic in shape and be made from a single piece of material. Such a base may include a faceted cone 3843 section and an integrated support panel 3847 as shown in FIG. 38A-38C. The outer cone cover may wrap around and be held together with a folded end flap that may be glued to the inside of the opposite end. The round inside bottom panel 3847 may have flanges 3838 around the perimeter that may be captured by tapered flanges 3842 at the bottom of the outer cone that fold under and may be glued to the bottom panel flanges. As may be seen in FIG. 38C, the formed base may include a number of sections 3859. The post opening may include tabs 3864 that may be folded in and down into the opening to provide a tight fit with the cylindrical post.

Figure 39:
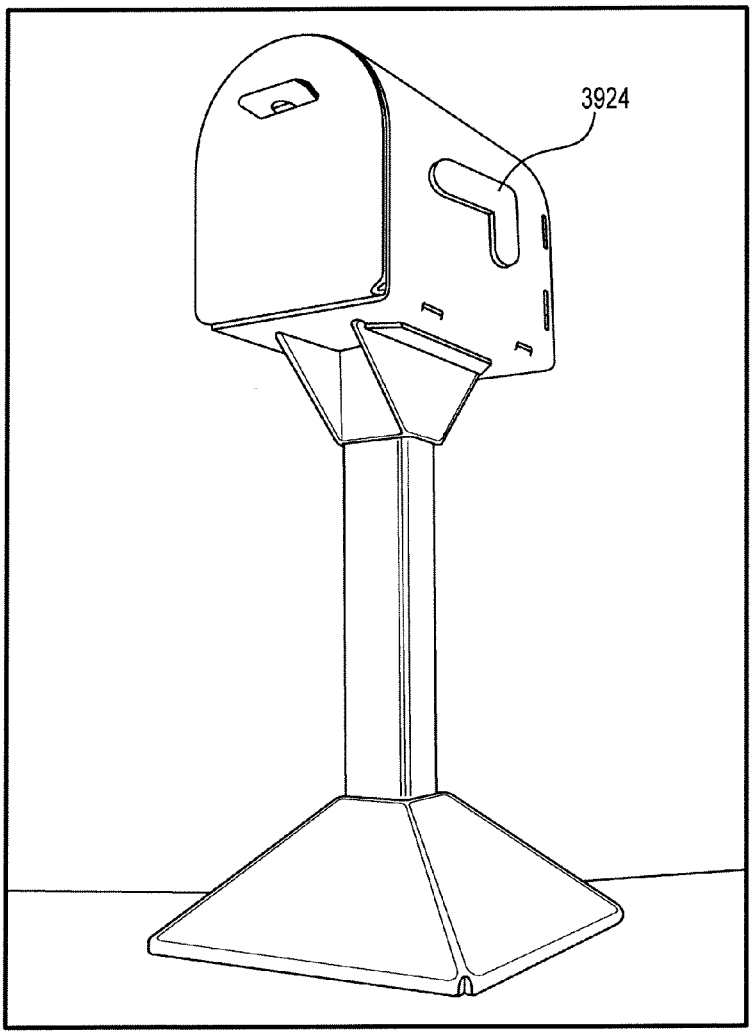
FIG. 39 shows a mailbox flag according to one embodiment.
Figure 40A:
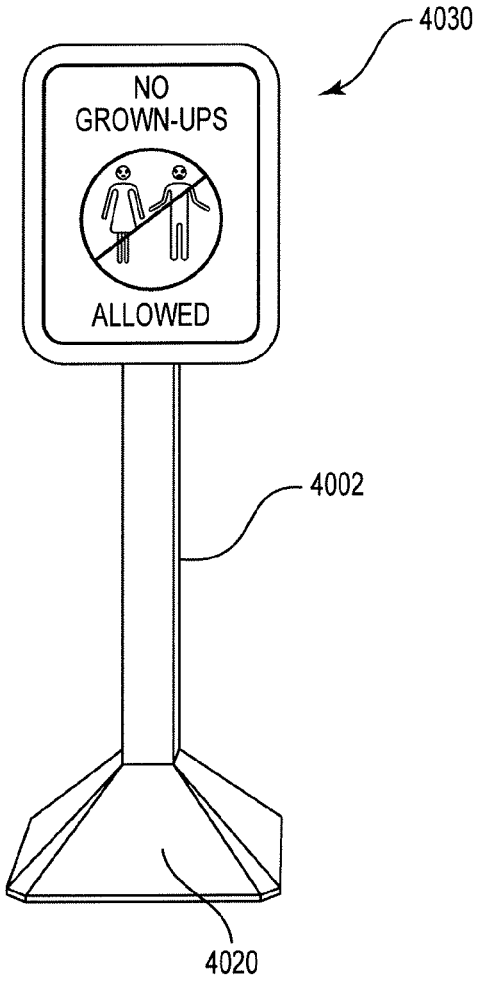
FIGS. 40A-40D show different embodiments of signs in accord with the present disclosure.
Figure 40B:
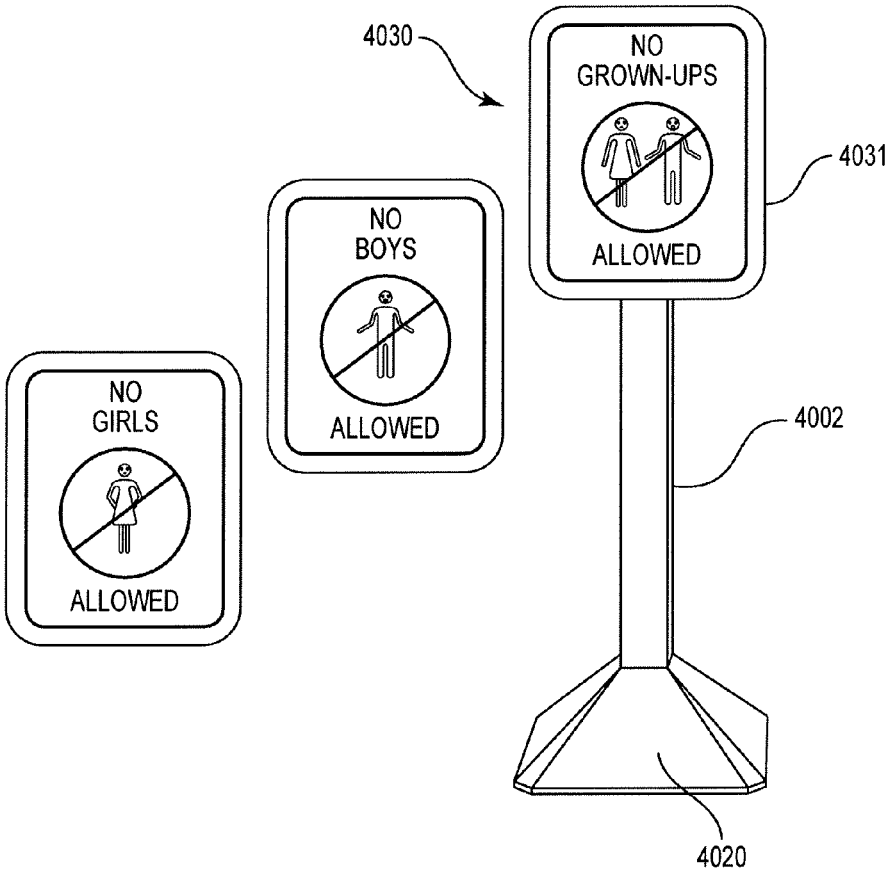
Figure 40C:
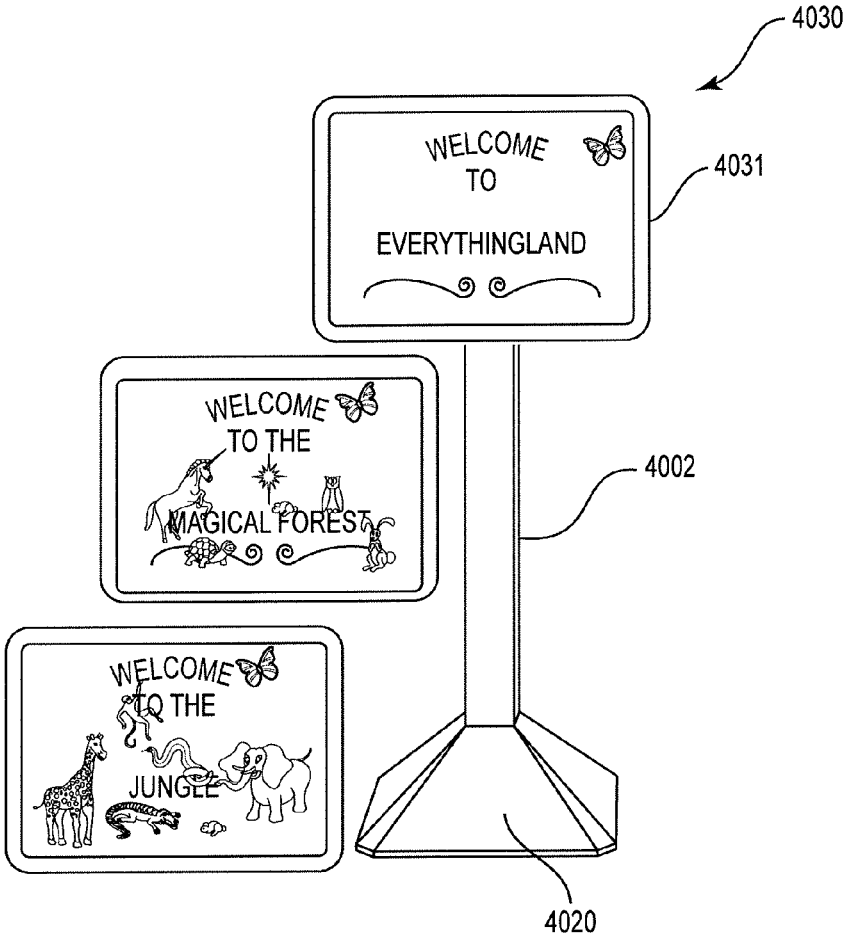
Figure 40D:
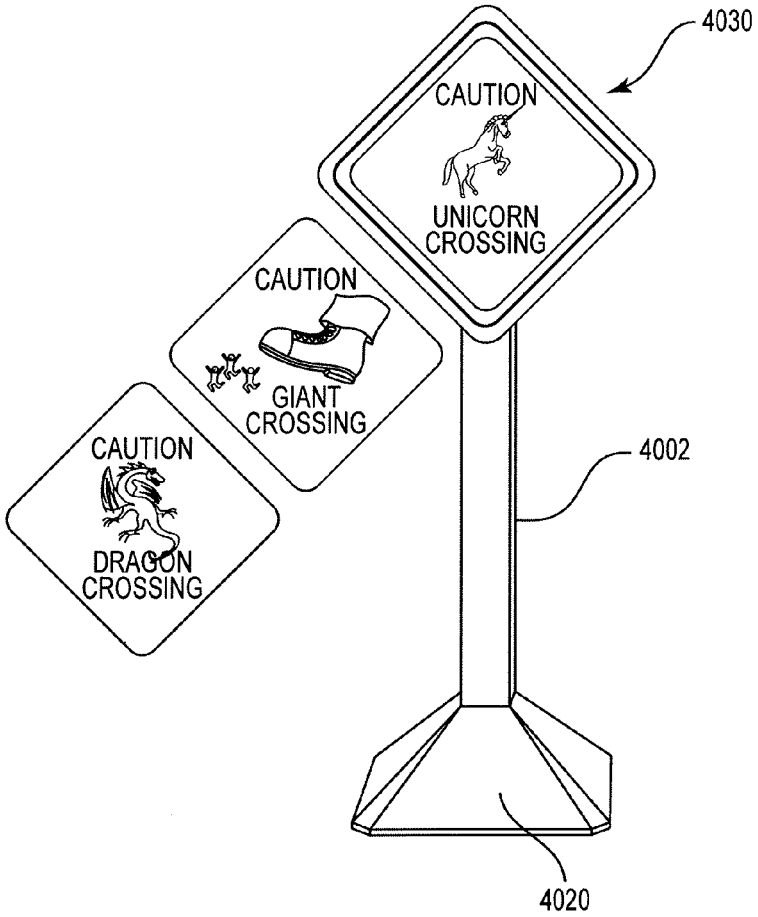

In some embodiments, a mailbox flag may also be attached to the mailbox. When in the up position, the flag can indicate that mail is in the receptacle, and when in the down position, the flag can indicate there is no mail in the receptacle. Of course, users are free to give the different positions of the flag any desired meaning. FIG. 39 shows an embodiment of a mailbox flag 3924. The flag may be comprised of the same or different material than the rest of the mailbox. In some embodiments the flag 3924 may be attached to the receptacle by any suitable means, for example by Velcro, snap, or any other suitable hinge or mechanism.

As explained previously, the mailbox in some embodiments may come fully or partially assembled, or in other embodiments may come unassembled and the user may assemble it. In such a case, the mailbox elements may come packaged together along with user instructions detailing step-by-step how the elements of the mailbox should be constructed and then how the elements fit together (i.e. the post attachment is secured to the bottom panel of the receptacle, one end of the post is positioned in and snapped into the post attachment and the other end is positioned in and snapped into the base. If the door and/or flag are stamped from separate pieces of material, these are also attached to the receptacle). Once the mailbox is assembled, or during assembly, the user may decorate the mailbox in any suitable way, as described previously. When the user wishes to discard the mailbox, the mailbox may be recycled (as long as none of the decorative materials are non-recyclable, in which case those materials should first be removed), in some embodiments.

Signs

In another embodiment of the present disclosure, the biodegradable toy that may be decorated may comprise a sign. The signs of the present disclosure may be scaled down versions of typical street signs and other humorous spoofs of common signs designed for kids to use in imaginary play, for example. As with the mailbox, the signs may be comprised of any suitable biodegradable or partially biodegradable and/or recyclable or partially recyclable materials, for example, but not limited to cardboard, other paperboard, clip board or any other sheet material or other suitable material or combination of materials. Further, the signs, like the mailboxes may be packaged fully assembled, partially assembled, or substantially unassembled. In cases where the signs are packaged partially or substantially unassembled, user instructions for assembling the elements of the sign may be provided. The signs may be packaged already decorated, while in other embodiments the signs may be packaged partially decorated or not decorated at all. Regardless, the user may decorate or further decorate or personalize the sign.

Exemplary embodiments of the sign are shown in FIGS. 40A-40D. The sign may include the following elements: post 4002, the base 4020, the post attachment (described further below), and the sign face 4030. The post 4002 and the base 4020 may be formed in the same manner as the post and the base used to create the mailbox. The dimensions of the post and/or base may vary as desired from the dimensions of the post and base used for the mailbox. The same variations described above for configuring the post and/or the base apply equally to the post and the base for the sign.

Figure 41A:
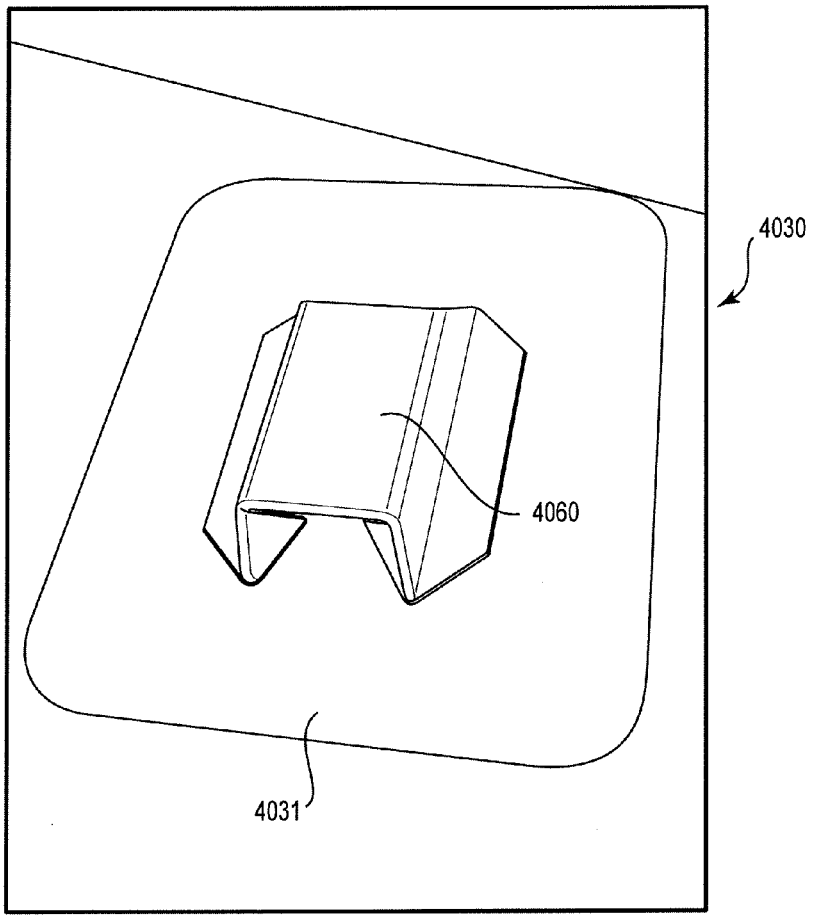
FIGS. 41A-41C show embodiments of post attachments for signs according to one embodiment.
Figure 41B:
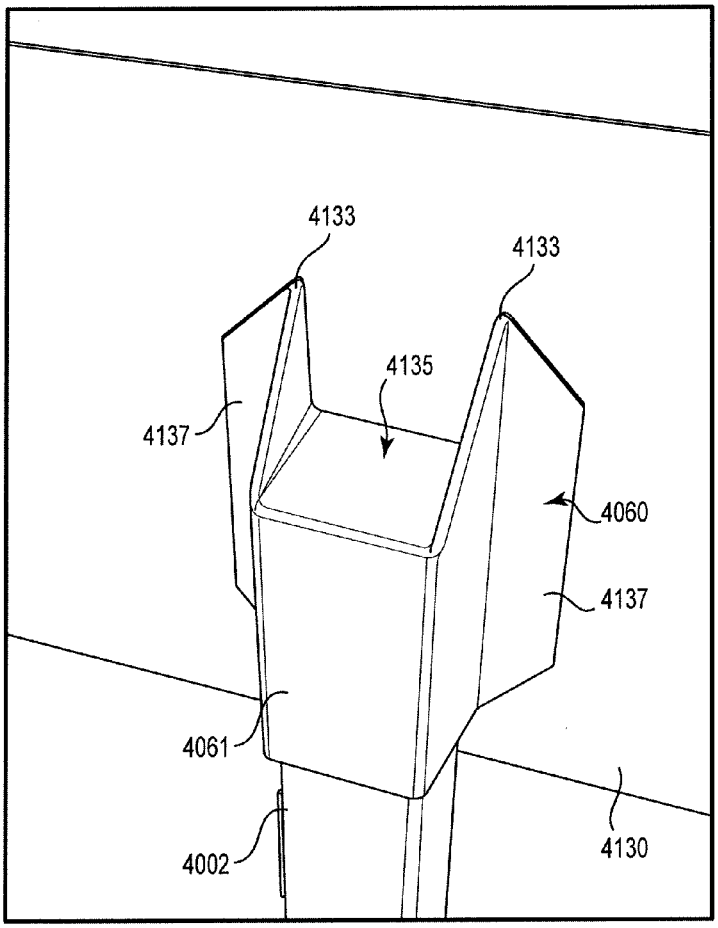
Figure 41C:
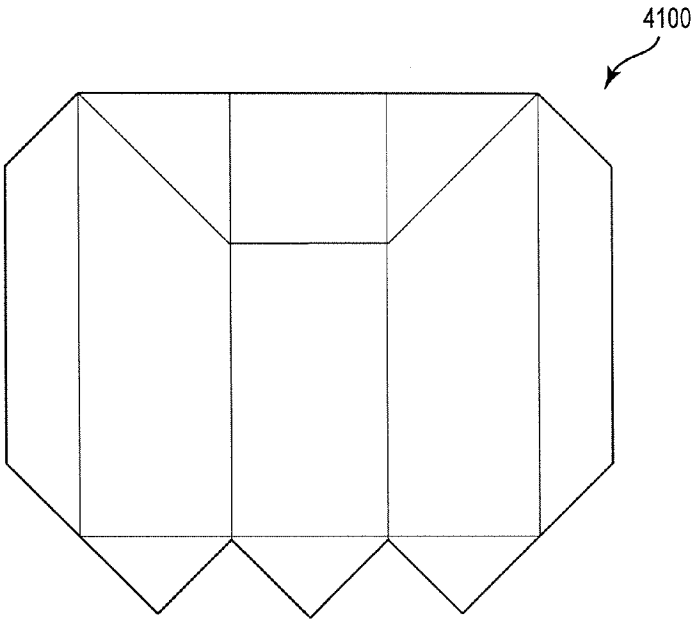

The sign post attachment 4060 may be mounted to the back side 4031 of the sign face 4030, as shown in FIGS. 41A-41C. The sign post attachment 4060 may be comprised from one piece of material or from two or more pieces of material formed to wrap around the post 4002. The post attachment may be glued or otherwise adhered to the back side 4031 of the sign face in a generally centered manner. FIG. 41C provides an exemplary pattern 4100 of a post attachment comprised form a unliterary piece of material. It will be understood however that variations to the design of the post attachment are possible, for example, the post may be a cylindrical post and accordingly, the post attachment may be formed to accommodate the cylinder as opposed to the square post shown in FIGS. 41A-41C. The sleeve 4061 may wrap around the post on three sides and the top may fold in to create two double thick gussets 4133 and a top cap 4135. Two flanges 4137 fold out to glue the piece to the back of the sign. Beveled fold-in tabs that fold into the square sleeve may be used to create a tight interference fit with the post and present a clean friendly edge at the base of the sleeve.

Figure 42A:
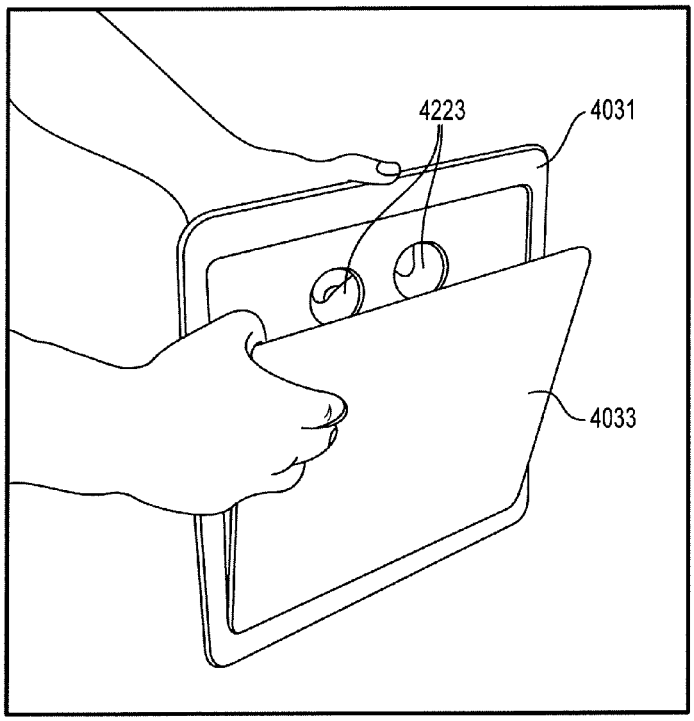
FIGS. 42A and 42B show an embodiment of a sign face including frame and interchangeable placards according to one embodiment.
Figure 42B:
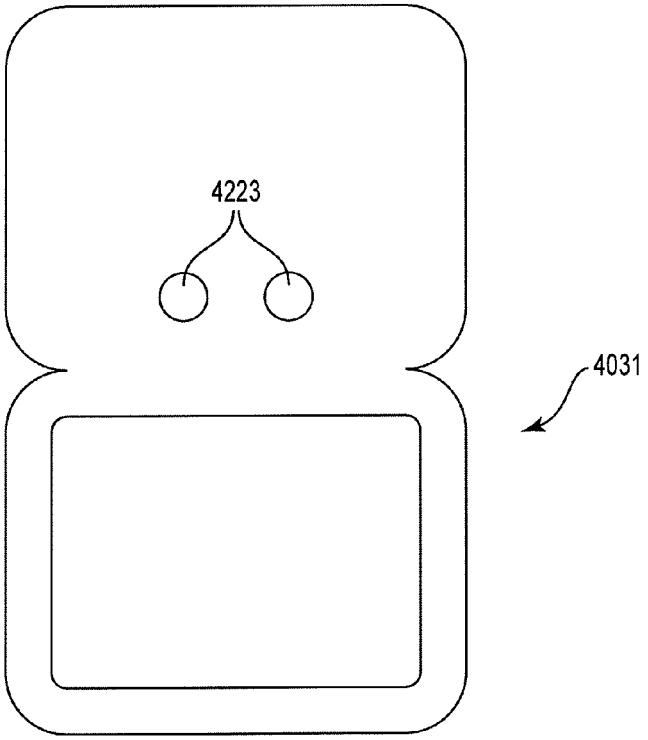

The sign face in some embodiments may comprise a single sheet of material, wherein a pre-printed message has been affixed or printed upon. In other embodiments, the front side of the sign face may be blank, thereby allowing a user to provide his or her own message and decorations. As may be seen in FIGS. 40A-40D any number of shapes and sizes for the sign face are possible and within the spirit and scope of the present disclosure. Similarly, any number of preprinted signs with any number of messages and/or pictures and/or symbols, for example are possible. In other embodiments, the sign face may include a frame 4031 whereby an interchangeable placard 4033 may be positioned, secured and then removed and replaced with another placard. As may be seen in FIG. 42B, the frame 4031 may be comprised of a unitary piece of material. One or more access points 4223 may be included in the back side of the frame 4031, such that the placard may be easily removed, as shown in FIG. 42A.

In the foregoing description various embodiments of the invention have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed is:

1. A biodegradable mailbox comprising:

a receptacle including a bottom panel, a back panel, a top, and an openable and closeable front door that form an interior space, the receptacle having a post attachment integral with the receptacle;

a vertically extending post with a first end and a second end, the first end being securely insertable into the post attachment of the receptacle; and a base for ground support into which the second end of the post is securely inserted;

wherein the entire mailbox is comprised of cardboard and contains no glue.

2. The mailbox of claim 1, wherein the receptacle and the post attachment are formed from one contiguous cardboard blank.

3. The mailbox of claim 1, wherein the receptacle is made from two or more cardboard blanks.

4. The mailbox of claim 3, wherein the cardboard blanks comprising the receptacle include prefolds.

5. The mailbox of claim 4, wherein the top of the receptacle includes a plurality of facets.

6. The mailbox of claim 5, wherein the receptacle includes eleven facets.

7. The mailbox of claim 6, wherein the back panel of the receptacle is coupled to the bottom panel by a double reverse fold, the back panel further including a tab and the top including a receiving slot into which the tab of the back panel is securely inserted.

8. The mailbox of claim 7, wherein the bottom panel is comprised of two layers of cardboard.

9. The mailbox of claim 5, wherein the post attachment comprises at least one beveled fold-in tab.

10. The mailbox of claim 5, wherein the post is substantially cylindrically shaped and configured to be received into a substantially cylindrically shaped sleeve of the post attachment.

11. The mailbox of claim 10, wherein the substantially cylindrically shaped sleeve of the post attachment comprises at least one triangular gusset.

12. The mailbox of claim 5, wherein the post is substantially rectangular in shape and configured to be received into a substantially rectangular shaped sleeve of the post attachment.

13. The mailbox of claim 12, wherein the substantially rectangular shaped sleeve of the post attachment comprises at least one triangular gusset.

14. A biodegradable mailbox comprising:

a receptacle including a bottom panel, a back panel, a top, and an openable and closeable front door that form an interior space, the receptacle being formed with two or more cardboard blanks, the cardboard blanks including prefolds, and the back panel of the receptacle being coupled to the bottom panel by a double reverse fold, the back panel further including a tab and the top including a receiving slot into which the tab of the back panel is securely inserted;

a vertically extending post with a first end and a second end, the first end being securely inserted into a post attachment, the post attachment being securely coupled to the receptacle; and a base for ground support into which the second end of the post is securely inserted.

* * * * *